US007025318B2

(12) United States Patent
Hurst et al.

(10) Patent No.: US 7,025,318 B2
(45) Date of Patent: Apr. 11, 2006

(54) CONTAINER SUPPORT

(75) Inventors: William S. Hurst, Burlington, WI (US); Sidney T. Smith, Lake Forest, IL (US); Pierre Caloz, Geneva (CH); Sindhu Ramachandran, Wheeling, IL (US); Michele M. Ulm, Antioch, IL (US); Jesse F. Rodriguez, Arlington Heights, IL (US)

(73) Assignee: Baxter International Inc., Deerfield, IL (US)

( * ) Notice: Subject to any disclaimer, the term of this patent is extended or adjusted under 35 U.S.C. 154(b) by 0 days.

(21) Appl. No.: 09/812,235

(22) Filed: Mar. 19, 2001

(65) Prior Publication Data

US 2003/0075663 A1 Apr. 24, 2003

(51) Int. Cl.
*A47H 1/10* (2006.01)

(52) U.S. Cl. ..... 248/331; 248/328; 248/332; 220/9.2

(58) Field of Classification Search ..... 248/332, 248/331, 328, 324, 325, 364; 206/583; 294/68.2, 68.3, 81.1, 81.56, 81.51; 187/250, 187/251; 222/105, 181.1, 181, 181.3; 383/22–24; 220/9.1–9.4

See application file for complete search history.

(56) References Cited

U.S. PATENT DOCUMENTS

| | | | | | |
|---|---|---|---|---|---|
| 279,186 | A | * | 6/1883 | Ricker | 182/70 |
| 530,389 | A | * | 12/1894 | Brooks | 182/103 |
| 1,127,397 | A | | 2/1915 | Boyajian | |
| 1,393,932 | A | * | 10/1921 | Achille | 182/129 |
| 2,316,384 | A | | 4/1943 | Abramson | |
| 2,389,601 | A | | 11/1945 | De Witt | |
| 2,722,171 | A | * | 11/1955 | Deringer | 99/646 R |
| 3,105,617 | A | | 10/1963 | Felldin | 222/185 |
| 3,106,441 | A | | 10/1963 | Harrison | 18/47.5 |
| 3,117,695 | A | * | 1/1964 | Cox, Jr. | 222/105 |
| 3,119,548 | A | | 1/1964 | Cook et al. | 229/53 |
| 3,194,471 | A | * | 7/1965 | Murphy | 229/117.29 |
| 3,212,681 | A | * | 10/1965 | Wekert | |
| 3,277,798 | A | | 10/1966 | Krauss | |
| 3,319,684 | A | * | 5/1967 | Calhoun | 604/326 |
| 3,367,380 | A | | 2/1968 | Dickey | 150/1 |
| 3,373,915 | A | | 3/1968 | Anderson et al. | |
| 3,413,898 | A | | 12/1968 | Calvert | |
| 3,549,451 | A | | 12/1970 | Kugler | |
| 3,599,538 | A | | 8/1971 | Piazze | |

(Continued)

FOREIGN PATENT DOCUMENTS

DE 2613724 A1 10/1977

(Continued)

*Primary Examiner*—Korie Chan
(74) *Attorney, Agent, or Firm*—Bell Boyd & Lloyd LLC; Paula J.F. Kelly; Joseph P. Reagen

(57) ABSTRACT

A container (10) having a plurality of panels (12–18) joined together to form a sleeve (64). The panels (12–18) each have an end edge that cooperate to define an imaginary plane (P) at one end of the sleeve (64). The container (10) further has an end panel (20,22) connected to the panels (12–18) at the one end of the sleeve (64). The end panel (20,22) has at least one portion extending beyond the imaginary plane (P). The supporting box (100) is provided to support the container (10). A hanger system (150) is provided and is attached to the box (100). The hanger system (150) supports an upper portion of the container (10) within the box (100). The container (10) is also provided with a port closure (300) that provides both a sterile and gas permeable barrier.

18 Claims, 13 Drawing Sheets

U.S. PATENT DOCUMENTS 3,599,539 A 8/1971 Coverstone et al.
3,683,595 A 8/1972 Houghton et al.
3,693,407 A 9/1972 McWhorter et al. ..... 73/420
3,807,901 A * 4/1974 Wilson ..... 138/30
3,827,341 A 8/1974 Stage
3,827,471 A * 8/1974 Gregory et al. ..... 222/181.3
3,893,595 A * 7/1975 Khanna et al. ..... 222/181.3
3,924,521 A 12/1975 Hanson et al.
3,940,018 A * 2/1976 Scholle ..... 206/506
3,961,655 A * 6/1976 Nattrass et al. ..... 383/24
4,027,774 A * 6/1977 Cote ..... 248/99
4,030,603 A * 6/1977 Angell ..... 206/497
4,057,211 A 11/1977 Moore ..... 248/332
4,165,024 A * 8/1979 Oswalt et al. ..... 222/105
4,182,386 A * 1/1980 Alack ..... 141/83
4,194,652 A * 3/1980 Williamson et al. ..... 222/181.3
4,227,527 A 10/1980 De Frank et al. ..... 128/214 R
4,235,196 A * 11/1980 Moliterni ..... 119/464
4,306,668 A * 12/1981 Love ..... 222/105
4,338,979 A * 7/1982 Dow ..... 248/101
4,373,936 A 2/1983 Becker
4,382,039 A * 5/1983 Goldschmitt et al. ..... 562/73
4,421,253 A * 12/1983 Croley ..... 222/105
4,527,716 A * 7/1985 Haas et al. ..... 222/83.5
4,550,442 A 10/1985 Lepisto
RE32,303 E 12/1986 Lasker et al.
4,671,029 A 6/1987 Bennett et al.
4,688,979 A * 8/1987 Kupersmit ..... 414/403
4,718,464 A 1/1988 Delves et al.
4,720,872 A 1/1988 Kaczerwaski
4,761,080 A 8/1988 Schirmer
4,781,472 A * 11/1988 LaFleur et al. ..... 383/16
4,817,824 A * 4/1989 LaFleur et al. ..... 222/105
4,909,410 A * 3/1990 Derby et al. ..... 493/210
4,935,971 A * 6/1990 Dunn et al. ..... 4/559
4,966,311 A * 10/1990 Taylor ..... 222/105
4,968,624 A 11/1990 Bacehowski et al.
4,998,991 A * 3/1991 Poulton ..... 222/181.3
5,000,620 A * 3/1991 Bonnema et al. ..... 405/221
5,059,084 A * 10/1991 Krein ..... 414/467
5,149,315 A 9/1992 Muhs
5,192,133 A 3/1993 Juel et al.
5,230,689 A * 7/1993 Derby ..... 493/210
5,269,579 A 12/1993 DeCrane
5,322,195 A * 6/1994 Ellis ..... 222/105
5,358,335 A 10/1994 LaFleur ..... 383/107
5,382,117 A * 1/1995 Rings et al. ..... 406/39
5,405,053 A * 4/1995 Zublin ..... 222/83.5
5,618,254 A 4/1997 Derby ..... 493/197
5,692,868 A * 12/1997 Riemersma ..... 414/403
5,725,119 A * 3/1998 Bradford et al. ..... 206/583
5,765,723 A * 6/1998 Wilcox ..... 222/1
5,788,121 A 8/1998 Sasaki et al.
5,810,478 A * 9/1998 LaFleur ..... 383/24
5,814,382 A 9/1998 Yannuzzi, Jr.
5,836,696 A 11/1998 Schnell ..... 383/120
5,851,072 A 12/1998 LaFleur
5,918,984 A 7/1999 LaFleur et al. ..... 383/8
5,971,613 A 10/1999 Bell
5,988,422 A 11/1999 Vallot
6,032,818 A 3/2000 Olsen ..... 220/495.06
6,045,539 A 4/2000 Menyhay ..... 604/256
6,046,443 A 4/2000 Ackerman et al.
6,076,457 A 6/2000 Vallot
6,095,688 A 8/2000 Nittel et al. ..... 383/105
6,139,482 A 10/2000 LaFleur ..... 493/217
6,148,914 A * 11/2000 Guieze ..... 166/163
6,308,855 B1 * 10/2001 Tisi ..... 220/495.01
6,371,646 B1 4/2002 LaFleur ..... 383/109
6,427,955 B1 8/2002 Sterner et al.
6,478,182 B1 11/2002 Karpisek
2002/0131654 A1 9/2002 Smith et al.
2003/0029982 A1 2/2003 Hurst et al.
2003/0075662 A1 4/2003 Hurst et al.

FOREIGN PATENT DOCUMENTS

DE 29912079 U * 7/1999
EP 0461874 A2 * 12/1991
FR 1215335 4/1960
GB 2121467 * 12/1983
GB 2121467 A 12/1983
JP 240601 A 9/1997
JP 126576 A * 5/2000

* cited by examiner

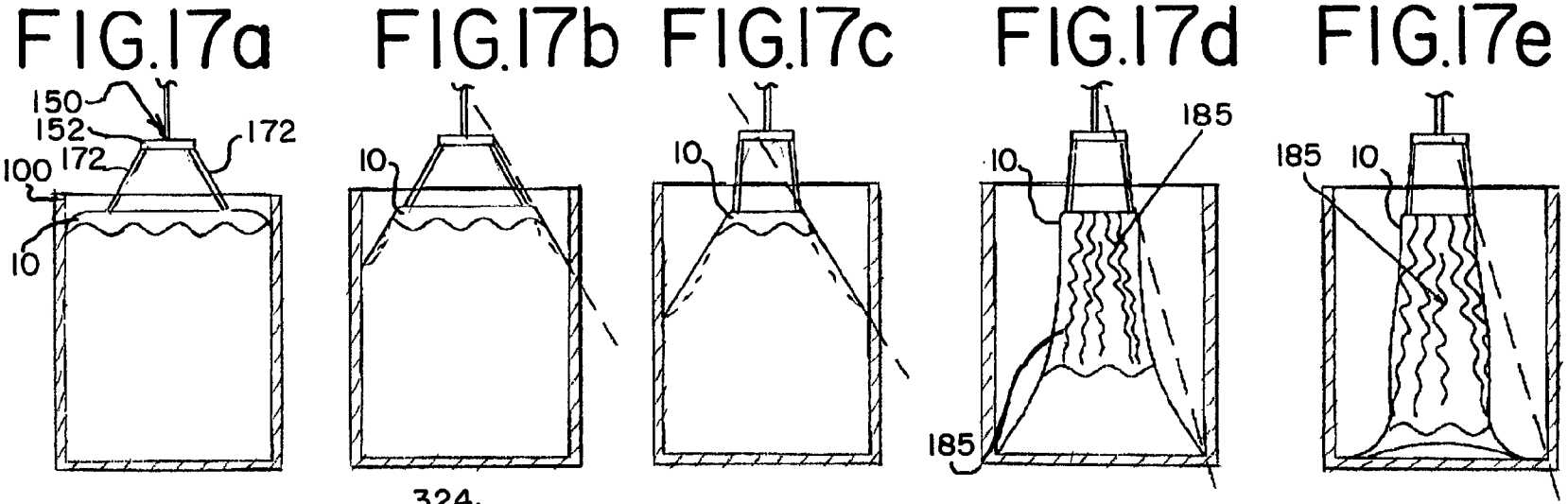
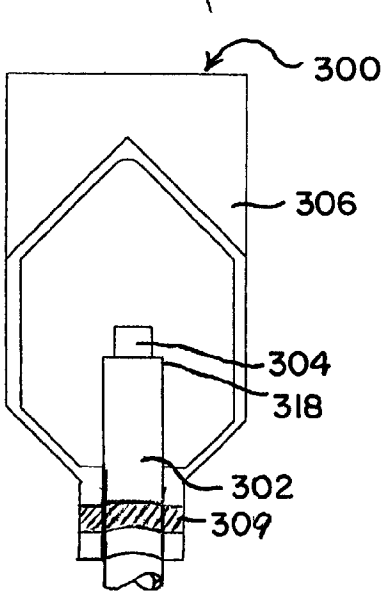
FIG.19
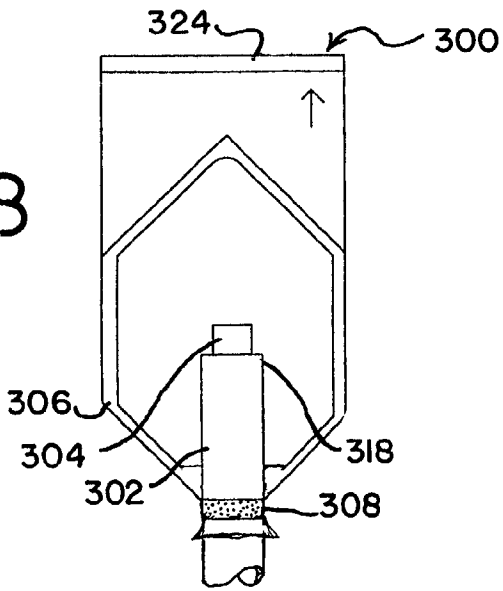
FIG.18

CONTAINER SUPPORT

DESCRIPTION

1. Technical Field

The present invention relates, in general, to flexible containers and, more specifically, to large volume, three-dimensional flexible containers.

2. Background of the Invention

Containers used for the shipping, storing, and delivery of liquids, such as therapeutic fluids or fluids used in other medical applications, are often fabricated from single-ply or multi-ply polymeric materials. The materials are typically in sheet form. Two sheets of these materials are placed in overlapping relation, and the overlapping sheets are bonded at their peripheries to define a chamber or pouch for containing the fluids. These types of bags are typically referred to as two-dimensional flexible containers, flat bags, or "pillow bags." U.S. Pat. No. 4,968,624 issued to Bacehowski et al. and commonly assigned to the assignee of the present application, Baxter International Inc. ("Bacehowski"), discloses a large volume, two-dimensional flexible container. These types of bags can reach volumes as large as 600 liters.

While 600 liters is a significant volume for a flexible container, there has been an ever increasing need to provide flexible containers of even greater volumes. This has lead to the development of three-dimensional flexible containers, sometimes referred to as "cubic bags."

In the design and use of three-dimensional flexible containers of such volumes, certain problems are encountered. The large volume of liquid held by the containers exerts a hydraulic force against seams of the container, which in an unsupported state, might be sufficient to cause failure of the container. Indeed, containers this large, when filled with water or some other liquid, can weigh over 3000 pounds. The forces associated with such liquid volumes can cause the container seams to fail or rupture, therefore causing leaks in the container. The liquid held by the container may not be a commodity solution but often a sterile, custom formulated solution. Accordingly, even a very small leak can be costly in that any seam rupture compromises sterility of the entire contents of the container. Also, a failure of a container seam can cause literally hundreds of liters of liquid to escape from the container. This is costly in replacing the lost liquid contents of the container. Clean-up costs are also encountered.

These large volume, three-dimensional flexible containers are not intended to be free standing, but rather, are designed to be supported by a rigid or semi-rigid support container commonly referred to as a box or tank. The box can be made of various materials, commonly stainless steel. The stainless steel material is naturally an optical obstruction from seeing into the box. Typically, an operator has to look down into the box from the top. The box may have an access door on a side wall to allow an operator to view the inside of the box. The door, however, is very small in size and cannot provide a full view of the flexible container within the box. The side walls may have a series of small sight openings to allow one determine the level of liquid in the container. Similarly, however, these small sight openings do not allow a full view of the container within the box.

By necessity, the box and flexible container will have some interaction. It is desirable for the filled flexible container to transfer the load and associated forces from the contained liquid to the box, so that minimal loads (preferably zero) are carried by the flexible container material, especially the container seams. It is also desirable that the container seams be fully supported to prevent container failures due to "creep," which refers to the loss of seal integrity due to low but continuous tensile forces.

Because of the size of the containers, it may be difficult to properly align the container within the box. While initially properly aligned, the flexible container may shift becoming misaligned during the container filling process. If misaligned, the container can have unwanted folds that do not properly expand when the bag is filled. Such container folds caused from misalignment can result in undue stress on the container seams leading to container failure.

For example, as the container is filled with liquid, the container inflates and conforms to the surrounding box. Ideally, the container conforms as close to the inner walls of the box as possible although pleating of the container can occur. At the appropriate time, the liquid is drained from the container wherein the container collapses. If the container is unsupported, it will tend to collapse in horizontal pleats. The pleats can trap liquid within the container thus preventing the container from being fully drained. In some cases, once the container is drained, the container has served its purpose and is then discarded. In other cases, the container may be refilled as part of a larger process. In these instances, a horizontal pleating of the container can restrict the desired realignment during the refilling process. This can result in poor orientation or loss of the effective volume of the container. It may also result in insufficient support of the container. Thus, it is also desirable to vertically support the container within the box to optimize the draining and filling processes. Vertical support of the container within the box is particularly important when filling the container a second time.

U.S. Pat. No. 5,988,422 is directed to a sachet for biopharmaceutical fluid products. While the sachet is a three-dimensional container, the container does not have optimal angular construction between sides of the container. This will impact how such a container can be supported in a surrounding box. Accordingly, optimal filling, draining, and re-filling of the container cannot be achieved.

Some large volume flexible containers often employ a rigid or semi-rigid tube used in the filling and draining of the container, often referred to as a "dip tube." The dip tube is attached to the top of the container and extends downward to the bottom interior surface of the container. The dip tube supports the center portion of the top panel of the container during draining much like a tent post. In this configuration, the dip tube creates vertical pleats during draining of the container, and also allows a refilling deployment for the container.

The dip tube, however, has several disadvantages. First, the dip tube cannot orient the distal vertical surfaces of the container if the container foot print geometry is more complex than a circle. In addition, as the container is drained, the walls of the container converge towards the center essentially creating loads of compression on the non-compliant dip tube. These compressive forces can cause several problems. The dip tube itself can buckle under these forces. The seal between the dip tube and the top of the container can be compromised. A bottom portion of the dip tube can also rupture the bottom of the container. Using a dip tube structure also increases the cost the container system. In addition, dip tubes are also often accompanied by a container vent to allow incoming air to displace fluid instead of collapsing the container material. Finally, the dip tube also provides another potential mode of contamination ingress to the contents of the container. Thus, there remains a need for a vertical support system for the container within the box that addresses the needs of draining and refilling without the added complexity of dip tubes and vents.

These large volume containers are also typically equipped with one or more ports equipped with a port closure for accessing the fluid within the container. The container may have the port in a bottom panel that opens into the container. Oftentimes, the port closure includes a tube having one end connected to the port. Because the container is often used in medical and biotechnical applications, the port closure must include means for maintaining the other free end of the tube free from contamination. In other words, the free end of the tube must be equipped with a sterile closure that prevents potential contaminants from entering the tube and container. It is also desirable, however, to allow air to enter the container because it facilitates manipulation of the container during handling and installation.

There are two common approaches for providing a sterile closure at the free end of the tube. First, the free end of the tube can be sealed shut. In this application, the tubing must be selected from a thermoplastic material such as PVC or polyethylene that permits sealing of the material. This material can be heat sealed or sealed using other sealing energies such as radio frequency or ultrasonics. Using a silicone tube is desirable in the manufacturing process applications where the container is used. For example, a pump can be connected to the tubing for long periods of time so that the fluid can be pumped from the container. The silicone tubing also has the ability to withstand high temperatures, especially when the end of the tube is sterilized using steam in place (S.I.P.) methodologies. One problem that exists in using a sealed silicone tube, however, is that while providing a sterile closure, it does not facilitate the free passage of gases. Gas transfer (venting) is desirable to facilitate manipulation of the container during handling and installation. In addition, to access a container having a sealed tube, an operator must use a sharp implement such as a knife, blade or other cutting utensil to open the tube. This introduces an opportunity to contaminate the tube, and also poses a risk of injury to the operator.

The second approach for providing a sterile closure at the free end of the tube is to use a formed element such as an injection molded part or stainless steel coupling. The tubing is fitted to the part or coupling, and then the part or coupling is covered with another mating injection molded part or coupling. Similar to the sealed tube approach, such fittings provide a sterile closure but do not provide for gas transfer without loss of sterility. In addition, using injected molded parts or stainless steel couplings is costly.

The present invention is provided to solve these and other problems.

SUMMARY OF THE INVENTION

The present invention relates to containers and, in particular, to large volume, three-dimensional flexible containers.

According to a first aspect of the invention, a container is provided having a plurality of panels joined together to form a sleeve. The panels each have an end edge that cooperate to define an imaginary plane at one end of the sleeve. The container further has an end panel connected to the panels at the one end of the sleeve. The end panel has at least one portion extending beyond the imaginary plane. According to another aspect of the invention, the panels form a polygonal sleeve. The portion of the end panel extends outwardly from the sleeve. Alternatively, the portion could extend inwardly towards the sleeve.

According to a further aspect of the invention, a large volume flexible container capable of containing a fluid to be maintained under sterile conditions is provided. The container has a first panel, a second panel, a third panel, and a fourth panel connected together to form a generally cubic structure. The first panel has a central segment adjacent an end segment. The central segment has a longitudinal edge and the end segment has a tapered edge extending from the longitudinal edge. An angle is defined between the longitudinal edge and the tapered edge. The angle is in the range from about 135.01° to about 138°. In a most preferred embodiment, the angle is 136°. This angle is maintained when the panels of the container 10 are welded together.

According to a further aspect of the invention, a support container, or box, is provided for supporting the three-dimensional flexible medical container filled with fluid. The box has a frame having a top portion and a bottom portion. The frame has a plurality of sidewalls connected together at their extremities forming a chamber therein. The frame further has a floor spaced from the bottom portion. The chamber is sized to receive the flexible medical container wherein a bottom wall of the container is supported by the floor and sidewalls of the container are supported by sidewalls of the frame. Each sidewall supports a generally transparent panel, preferably a polycarbonate panel, such as Lexan™.

According to another aspect of the invention, a hanger system is provided for providing vertical support of the container supported within the box. A support member is connected to a top portion of the box. A hanger is provided having a plurality of depending members adapted to be connected to an end panel of the container. The hanger is connected to the support member. In a preferred embodiment, the hanger includes a first member and a second member connected together substantially at their respective midportions to form an x-shaped member. The depending members are pivotally connected to ends of the hanger members.

According to yet another aspect of the invention, a port closure for the container is provided. The port closure provides a means for providing a sterile and gas permeable barrier over the port. In one embodiment, the port closure has a communication member having a first end and a second end, the first end adapted to be in communication with the container. A stop member is inserted into the second end of the communication member wherein the stop member is made from a porous material. A cover member is provided and receives the second end of the communication member. The cover member is releasably secured to the communication member. In a preferred embodiment, the communication member is a tube made from a thermoplastic material. The stop member is a plug. An elastic band is wrapped about the pouch and the communication member releasably securing the cover member to the communication member. A tamper evident feature can also be incorporated into the port closure.

Other advantages and aspects of the present invention will become apparent upon reading the following description of the drawings and detailed description of the invention.

BRIEF DESCRIPTION OF THE DRAWINGS

FIGS. 17*a–e* are schematic views of a draining process of the container supported by the container hanger system;

FIG. 18 is a plan view of a port closure used with the container;

FIG. 19 is a plan view of the port closure of FIG. 18 in an alternative configuration;

DETAILED DESCRIPTION

Figure 1:
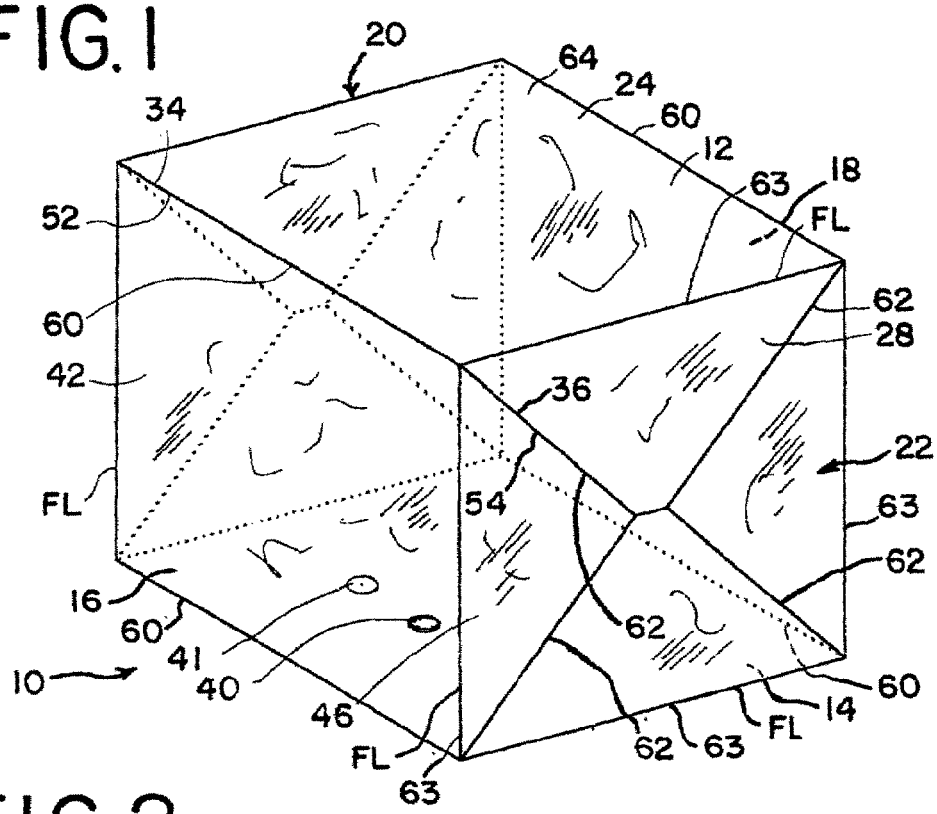
FIG. 1 is a perspective view of a medical fluid container of the present invention.

While this invention is susceptible of embodiments in many different forms, there is shown in the drawings and will herein be described in detail a preferred embodiment of the invention with the understanding that the present disclosure is to be considered as an exemplification of the principles of the invention and is not intended to limit the broad aspect of the invention to the embodiments illustrated.

Figure 2:
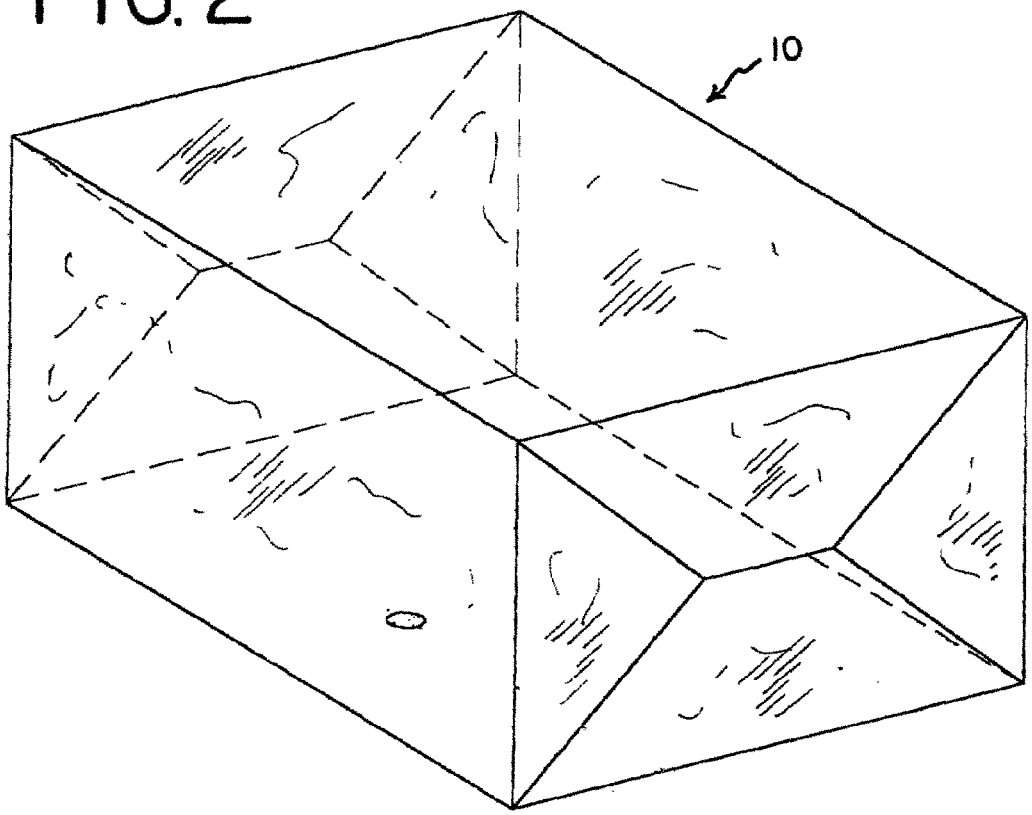
FIG. 2 is a perspective view of another medical fluid container of the present invention that is larger than the container shown in FIG. 1.
Figure 3:
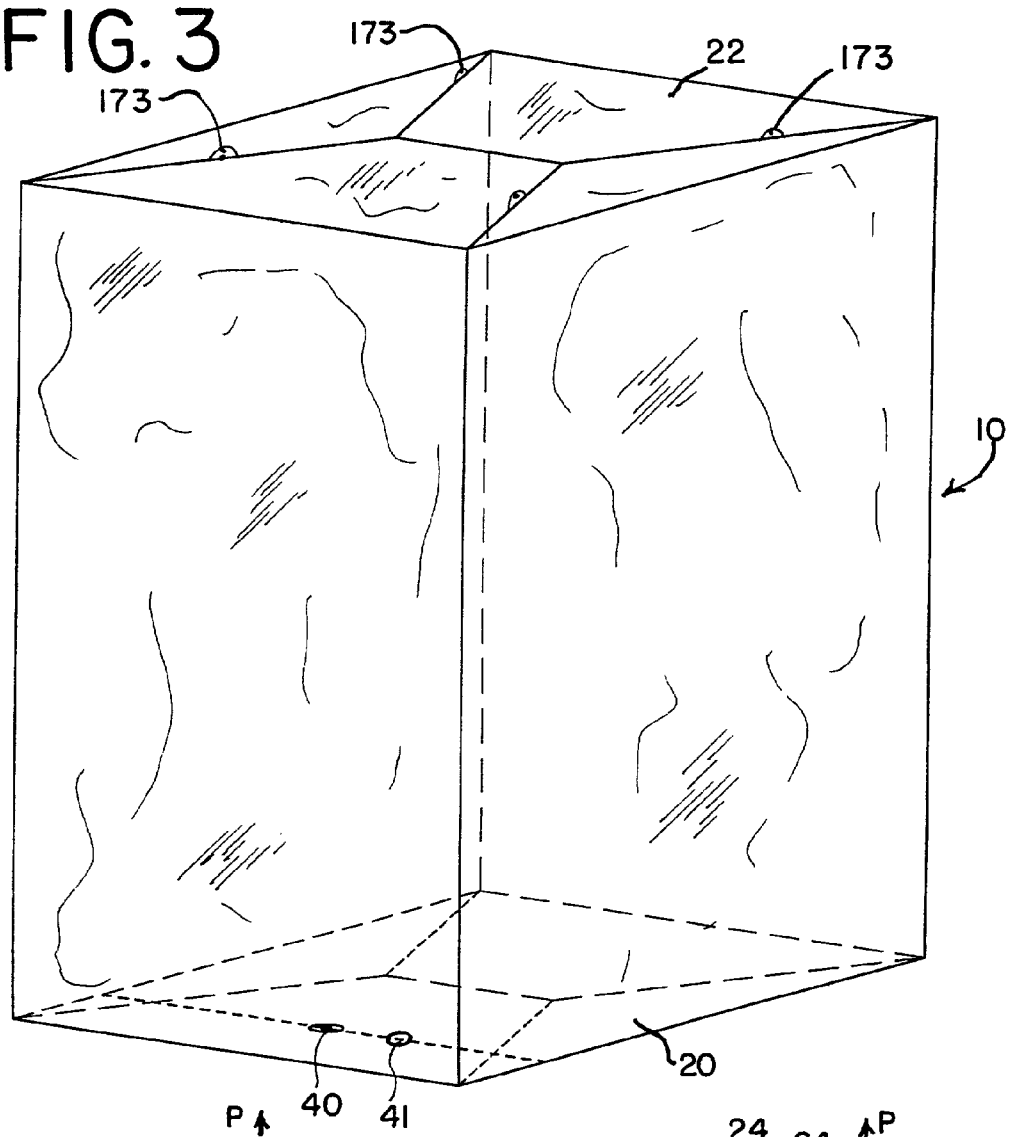
FIG. 3 is a perspective view of another medical fluid container of the present invention that is larger than the containers shown in FIGS. 1 and 2, and shown in a vertical configuration.

Referring to the drawings, FIG. 1 shows a container made in accordance with the present invention generally referred to with the reference numeral 10. The container 10 is a three-dimensional container capable of holding large amounts of fluid. The container 10 shown in FIG. 1 holds approximately 200 liters of fluid. The container 10, however, can be made in a variety of sizes. For example, FIG. 2 shows a container 10 sized to hold approximately 500 liters of fluid, and FIG. 3 shows a container 10 sized to hold approximately 1500 liters of fluid. The container 10 has a unique configuration that reduces seam stress to the container 10 caused by hydraulic forces generated from the fluid held in the container 10.

As shown in FIG. 1, the container 10 is three-dimensional and generally has a rectangular shape having six sides, or sometimes referred to as having four sides and two ends.

The container 10 is generally formed from four panels: a first panel 12 or top panel 12, a second panel 14 or bottom panel 14, a first side gusseted panel 16 and a second side gusseted panel 18. These walls 12–18 form four panels of the container and end portions of each wall cooperate to form the remaining two panels of the three-dimensional container 10, a first gusseted end panel 20 and a second gusseted end panel 22. The individual walls will first be described and then the connections between the walls will be described to show the structure of the container 10.

Figure 5:
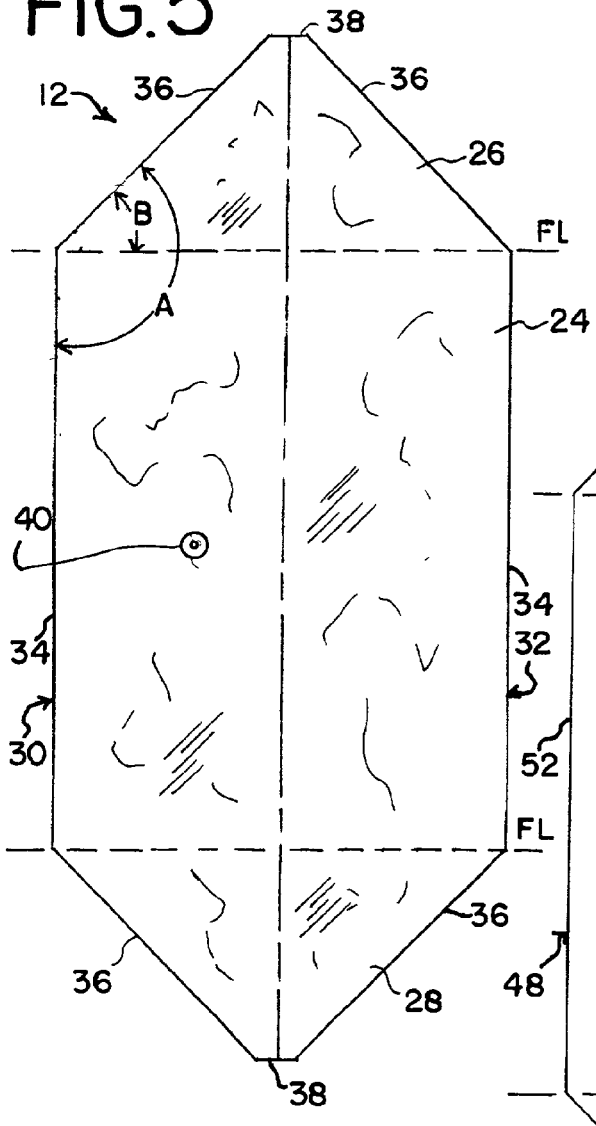
FIG. 5 is a plan view of a panel of the container.

FIG. 5 shows a plan view of the first panel 12 or top panel 12. It is understood that the second panel 14 or bottom panel 14 has a similar structure and will not be individually described. The top panel 12 generally has a central segment 24, a first end segment 26 and a second end segment 28. A fold line FL represents an interface between the central segment 24 and the end segments 26,28. The end segments 26,28 are folded and cooperate with end segments of the other panels to cooperatively form the end panels 20,22 as will be described in greater detail below.

As further shown in FIG. 5, the top panel 12 has a first peripheral edge 30 and a second peripheral edge 32. Each peripheral edge 30,32 has a longitudinal portion 34 at the central segment 24 and a tapered portion 36 at the first end segment 26 and the second end segment 28. At each end segment 26,28, the tapered portions 36 converge toward one another but do not meet. Rather, the tapered portions 36 meet an end edge 38. As will be described in greater detail below, the longitudinal portion 34 of the peripheral edge 30,32 meets the tapered portion 36 at an angle A. Similarly, an angle B exists between the tapered portion 36 and the fold line FL. Preferred measurements of the angles A and B will be described in greater detail below that optimize the seam strength of the container 10. The top panel 12 can include a port 40 if desired. The bottom panel 14 could also have a port 40. An additional port 41 could also be provided (FIG. 1). It is understood that a port could be placed in any panel of the container 10.

Figure 6:
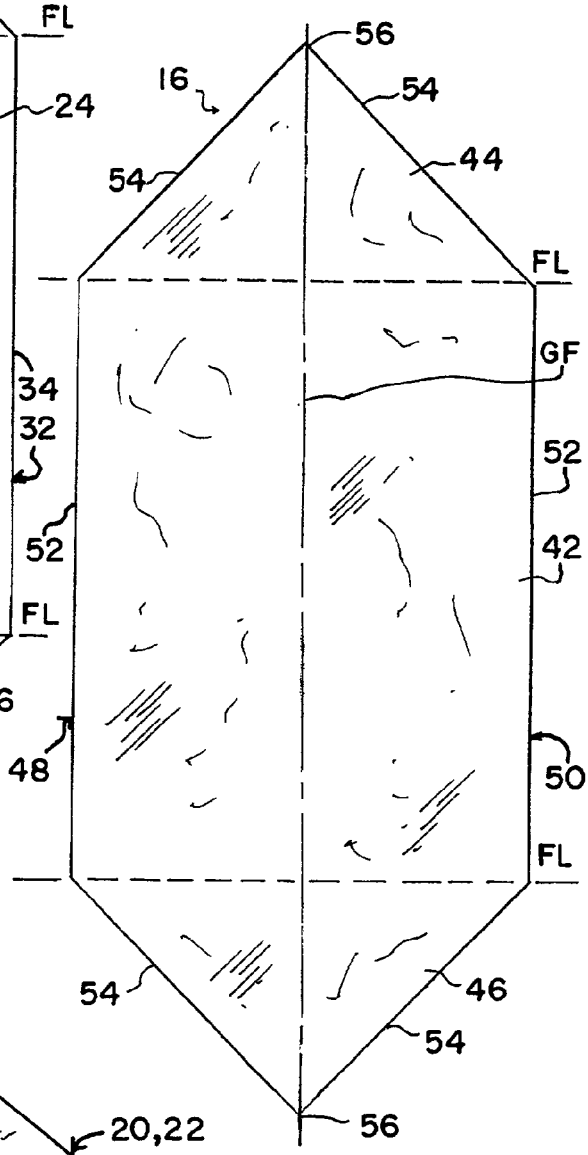
FIG. 6 is a plan view of a gusseted panel of the container.

FIG. 6 discloses a plan view of the first side gusseted panel 16. It is understood that the second side gusseted panel 18 has similar structure and will not be separately described. The first side gusseted panel 16 also has a gusset central segment 42, a first gusset end segment 44 and a second gusset end segment 46. A fold line FL represents an interface between the gusset central segment 42 and the gusset end segments 44,46. The gusset end segments 44,46 are folded and cooperate with top and bottom panel 12,14 end segments 26,28 to cooperatively form the end panels 20,22 as will be described in greater detail below.

As further shown in FIG. 6, the gusseted panel 16 has a first peripheral edge 48 and a second peripheral edge 50. Each peripheral edge 48,50 has a longitudinal portion 52 at the central segment 42 and a tapered portion 54 at the first gusset end segment 44 and the second gusset end segment 46. At each gusset end segment 44,46, the tapered portions 54 converge toward one another and meet at a point 56. As will be disclosed, the gusseted panels 16,18 have a gusset fold GF at generally a center-line of the panel. The panels 16,18 fold inwardly at the gusset fold GF.

In constructing the container 10 into a three-dimensional form, the peripheral edges of the panels 12–18 are generally joined by suitable means known in the art, such as heat energies, RF energies, sonics or other sealing energies. The first and second gusseted side panels 16,18 are positioned to space the top panel 12 and the bottom panel 14. The peripheral edges of the top panel 12 are sealed to respective peripheral edges of the gusseted side panels 16,18 to form seams. Similarly, the peripheral edges of the bottom panel 14 are sealed to the opposite peripheral edges of the gusseted side panels 16,18. Specifically, for example, the peripheral edge 30 of the top panel 12 is sealed to the peripheral edge 48 of the first gusset panel 16 wherein the respective longitudinal portions 34,52 are sealed together to form a side seam 60 (FIG. 1), and the respective tapered portions 36,54 are sealed together to form end panel seams 62. In this fashion, and as shown in FIG. 1, the flexible container 10 is formed having a generally three-dimensional rectangular shape. The central segments 24,42 of the panels 12–18 form the sides of the container 10. The end segments 26,28 of the first and second panels 12,14 and the end segments 44,46 of the gusseted side panels 16,18 cooperate to form the gusseted end panels 20,22. In this configuration, the end segments 26,28,44,46 serve as connecting members to form the end panels 20,22. The end segments converge towards one another and can be configured to join at a point, a line or a polygon. In a preferred embodiment, the end segments converge to a line. It is further understood that the container 10 can be configured into any number of N-sided polygonal shapes. It is further understood that the individual panels could be comprised of a plurality of separate panels connected together to form the panels of the container 10. This may be done, for example, in making a container 10 even larger than the 1500 L container shown in FIG. 3.

Figure 4:
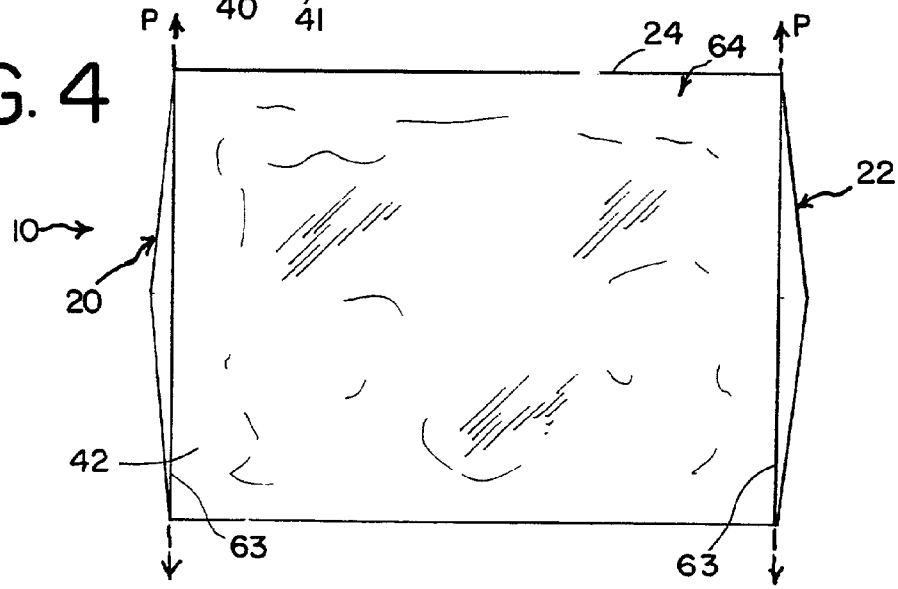
FIG. 4 is a side elevation view of the container of FIG. 1.

In a typical construction of a three-dimensional container, angle B would be 45° creating the angle A (FIG. 5) between the longitudinal portion 34 and tapered portion 36 of the peripheral edge 30,32 of 135°. This would provide a construction such that the end panels 20,22 would be generally perpendicular to the central segments 24,42 of the panels 12–18. In the container 10 of the present invention, the angle A is increased from 135° to within a range from about 135.01° to 138°. In a most preferred embodiment, the angle A is about 136°. By increasing this angle, more material is provided in the gusseted end panels 20,22. As shown in FIG. 4, this extra material allows the end panels 20,22 to extend outwardly from the central segments 24,42 providing a "pent roof" (See FIGS. 2, 4 and 7). As further shown in FIG. 4, the panels 12–18, when connected together form a sleeve 64. In the preferred embodiment, the sleeve 64 is in the form of a rectangular parallelpiped shape. The panels each have an end edge 63 that correspond to the end of the central segments 24,42 at the fold lines FL. The end edges 63 define an imaginary plane P at the end of the sleeve 64. The end panel 20,22 has at least one portion that extends beyond the imaginary plane P. In a most preferred embodiment, the end panel is contiguous with the sleeve and the entire end panel 20,22 extends beyond the imaginary plane P. In this configuration, the end edges of the sleeve 64 are represented by the fold lines FL. With this extended configuration, when the container 10 is filled with liquid, stresses on the end panel seams 62 are reduced. This also prevents additional stresses from being transferred to other portions of the container 10.

Figure 8:
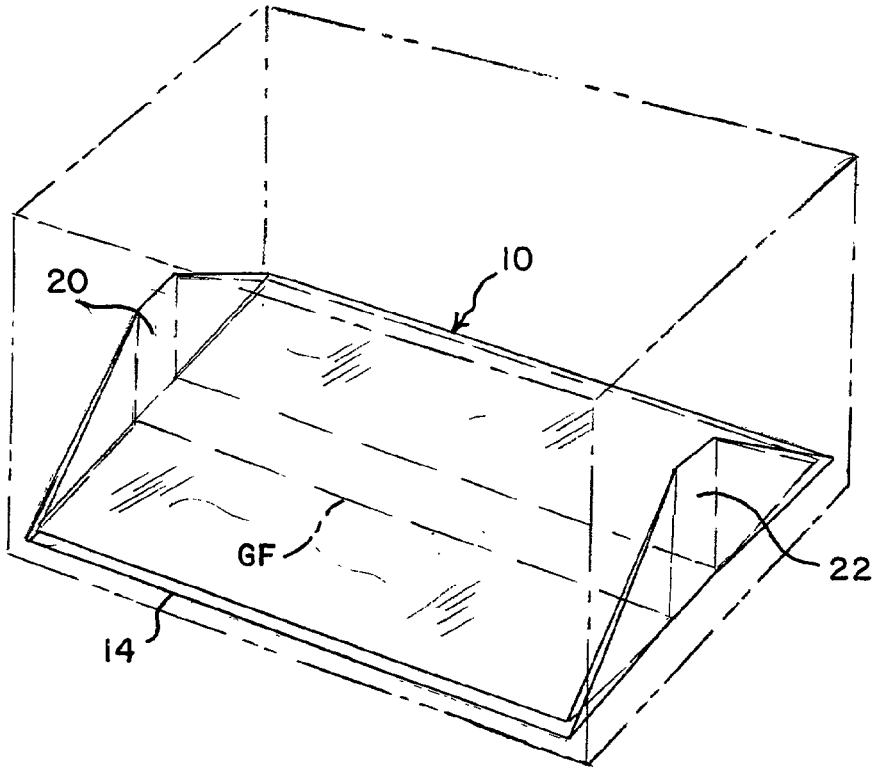
FIG. 8 is a perspective view of the container of the present invention in a generally folded configuration, a supporting box being shown in phantom lines.
Figure 9:
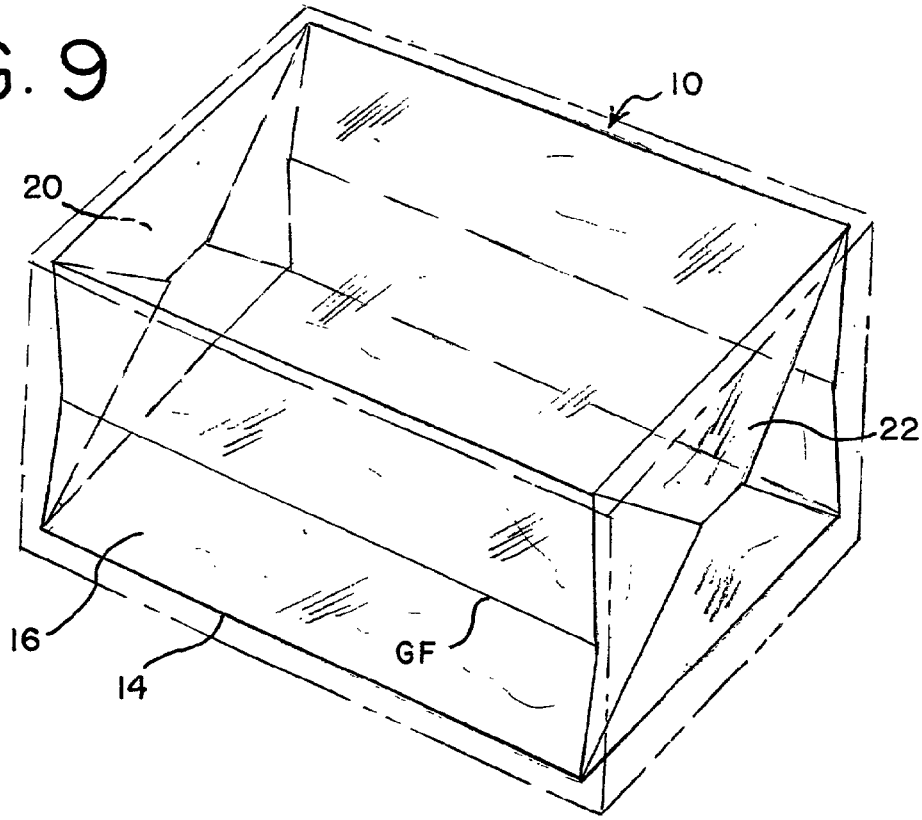
FIG. 9 is a perspective view of the container of FIG. 8 filled with fluid during a filling process.

FIGS. 8 and 9 disclose a filling process for the container 10 such as shown in FIGS. 1 and 2, e.g. a container 10 in a horizontal configuration. For initial clarity, the container 10 is shown out of the supporting box (to be described) although it is understood that the container 10 is filled with liquid after being positioned in the box. The container 10 is positioned horizontally with the bottom panel 14 against the base of the box. The container 10 is flattened wherein the first and second gusseted side panels 16,18 can be folded inward to the container 10 although they are shown extended in FIG. 8. The gusseted end panels 20,22 are folded over on top of the top panel 12 when the container is in a supporting box. In this configuration, the container is easily filled. As shown FIG. 9, as the container 10 is filled, the gusseted side panels 16,18 begin unfolding. Because each panel 16,18 has a single horizontal fold GF, as opposed to vertical gusset folds, there is less of a chance for the panels 16,18 to hang-up against the box and not fully unfold. If the panels 16,18 hang-up against the box, it prevents the container 10 from being fully inflated, which can place undue stress on the container seams during filling and transportation of the container 10. FIG. 9 shows the container 10 partially filled.

FIG. 2 discloses another container 10 that is designed to hold approximately 500 liters. FIG. 3 discloses an even larger container 10 designed to hold approximately 1500 liters. In containers 10 of the size shown in FIG. 3, it is sometimes desirable to configure the container such that gusseted end panels 20,22 are at the top and bottom of the container 10. Containers of this configuration can be as much as 15 feet in height. This gives the container 10 a smaller footprint, which is desirable so it can be carried on a standard pallet. A vertical footprint also minimizes the floor space occupied by the container, which can be important in storing a large quantity of containers. The container 10 has a generally rectangular footprint which provides a greater overall volume than a generally cylindrical container of the same height. It is understood that in a container 10 having a vertical configuration (FIG. 3), one of the end panels 20,22 may be referred to as a bottom panel such as end panel 20 shown in FIG. 3.

Figure 10:
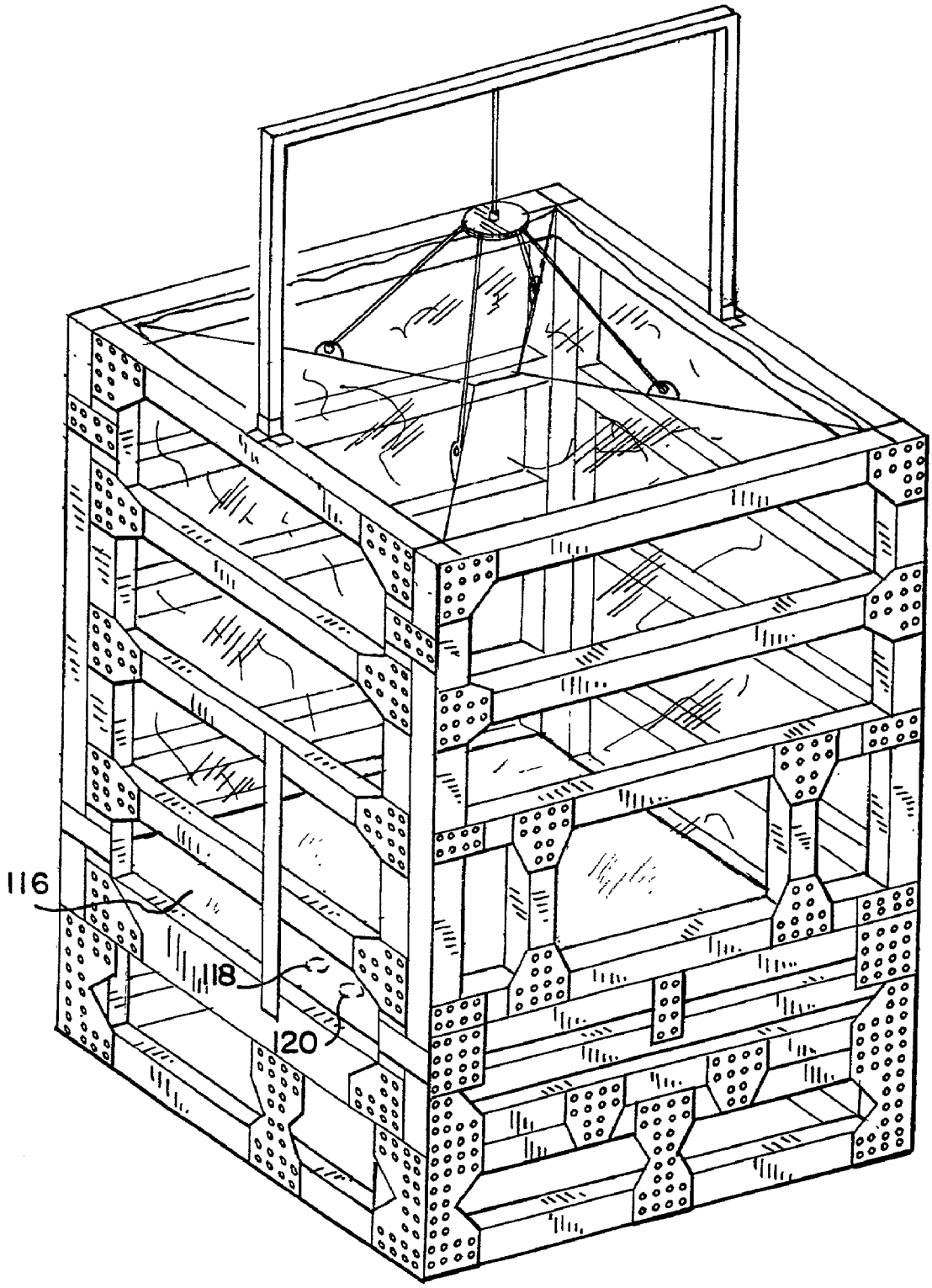
FIG. 10 is a perspective view of a box used to support the container, the container being positioned in the box.
Figure 12:
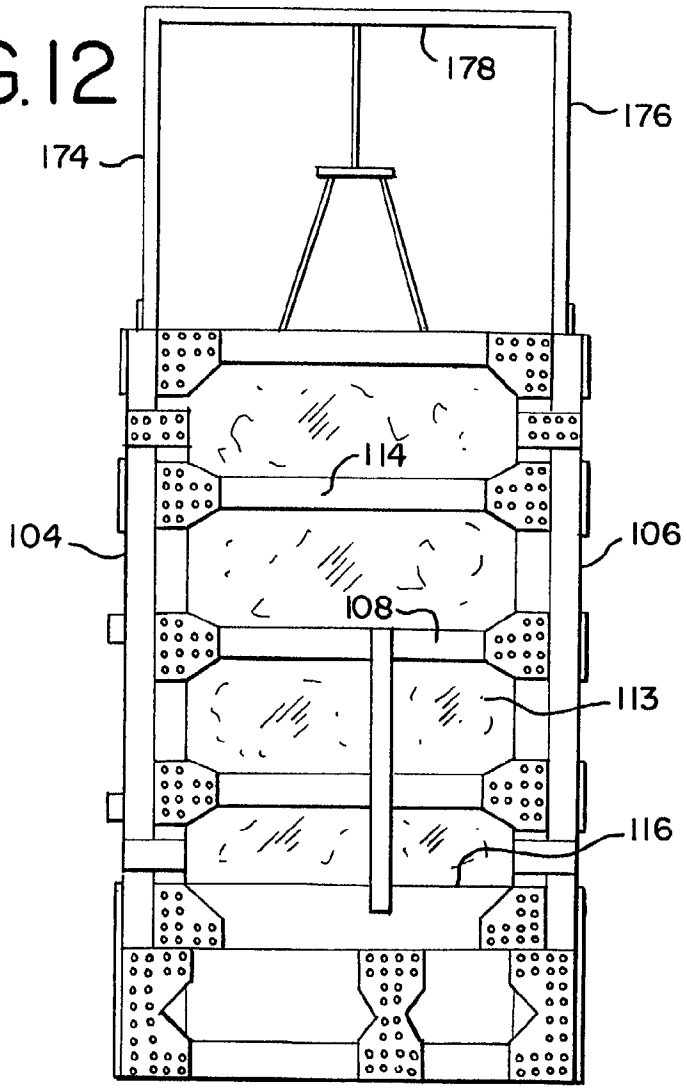
FIG. 12 is a side elevation view of the container of the present invention supported in the box utilizing the container hanger system.
Figure 11:
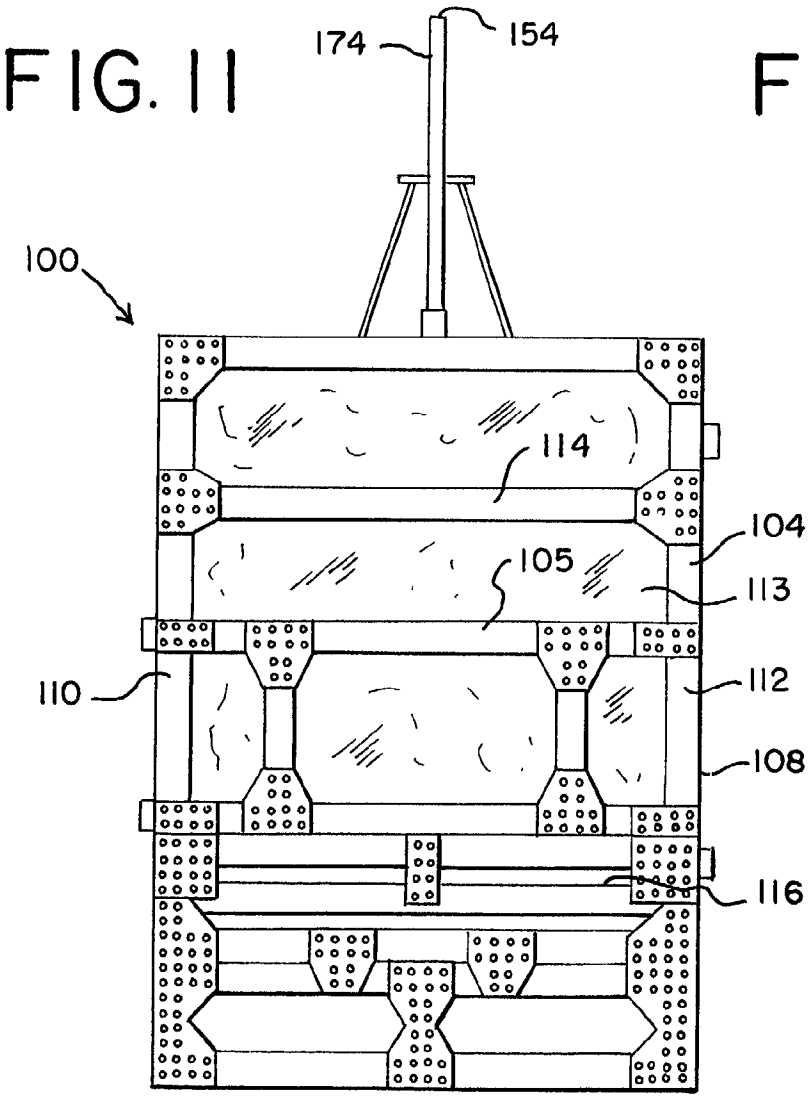
FIG. 11 is a front elevation view of a container of the present invention supported in a box and utilizing a container hanger system.

The container 10 of the present invention is not designed to be self-supporting, but is rather supported by a supporting container 100 or rigid box 100. FIGS. 10–12 disclose the box 100 that supports the container 10. The box 100 disclosed in FIGS. 10–12 is designed to support a container 10 in a vertical configuration such as shown in FIG. 3 although it is understood that a box 100 can be configured to support a container 10 in a horizontal configuration. The box has an outer frame made up of a plurality of frame members 102. The frame members 102 are connected together to form a front wall 104, a rear wall 106 and two sidewalls 108,110. The walls 104–110 are connected together to form a chamber having a generally square or rectangular cross-section. Each wall 104–110 has vertical members 112 and cross-members 114 to add rigidity to the walls. A bottom portion of the vertical members 112 are adapted to rest on a supporting floor surface. The frame members 102 of each wall 104–110 support a panel 113. In a most preferred embodiment, the panels are clear polycarbonate panels such as Lexan™ panels. The frame members 102 of the walls 104–110 and the panels 113 cooperate and are referred to as side panels of the box 100. The front wall 104 has a door 105 that is removably connected to the front wall 104. The door 105 allows access to the inside of the box 100 prior to filling the container 10 placed in the box 100. The box 110 further has a bottom wall 116 that is positioned inward from the bottom portions of the vertical members 112 so that the bottom wall 116 is slightly raised from the supporting floor surface. The bottom wall 116 has a first opening 118 and a second opening 120. These openings 118,120 will correspond to the ports 40,41 located on the container 10. The openings 118,120 help to properly locate the container 10 within the box 100. The top portion of the box 100 is open and is designed to receive the flexible container 10. When the flexible container 10 is inserted into the box 100, a discharge port and hose connected to the container (See e.g., FIG. 20) is fed through the first opening 118. The container 10 will also have a second port 41, which may be closed, that is inserted into the second opening 120 and assists in further properly locating the container 10 within the box 100. The container 10 is positioned such that the bottom panel 20 of the container 10 is supported by the bottom wall 116 and the corners of the bottom panel 20 of the container 10 are positioned substantially at the corners of the bottom wall 116. The container 10 is then connected to the hanger system to be described and then is ready to be filled.

Figure 13:
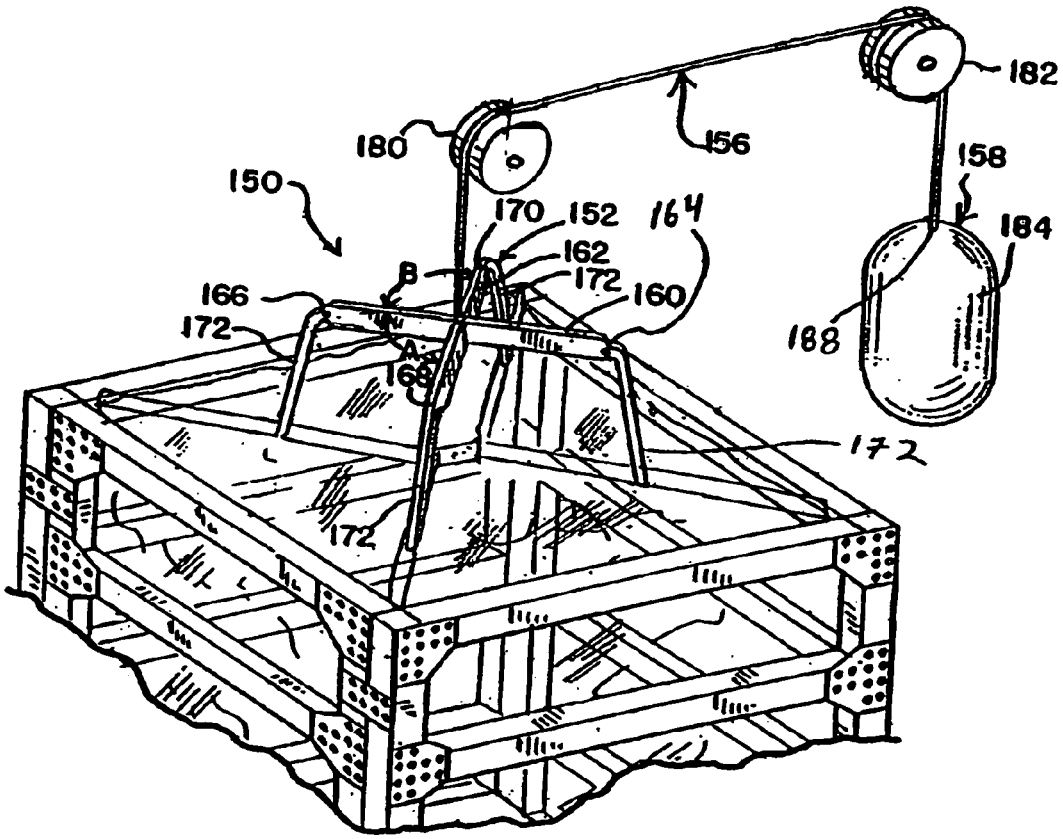
FIG. 13 is a perspective view of the container hanger system of the present invention.
Figure 14:
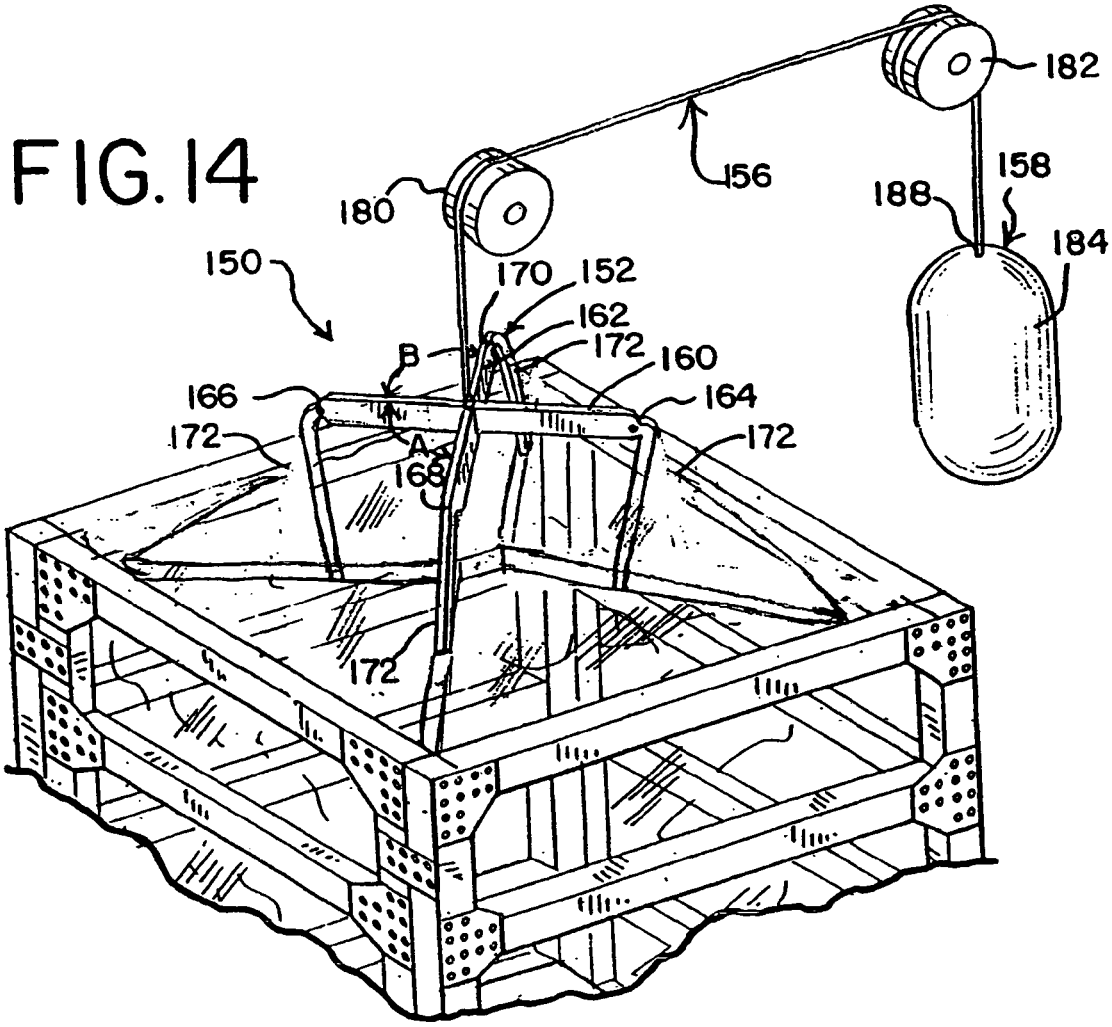
FIG. 14 is a top view of the container in the box of FIG. 13 wherein the container is partially drained.
Figure 15:
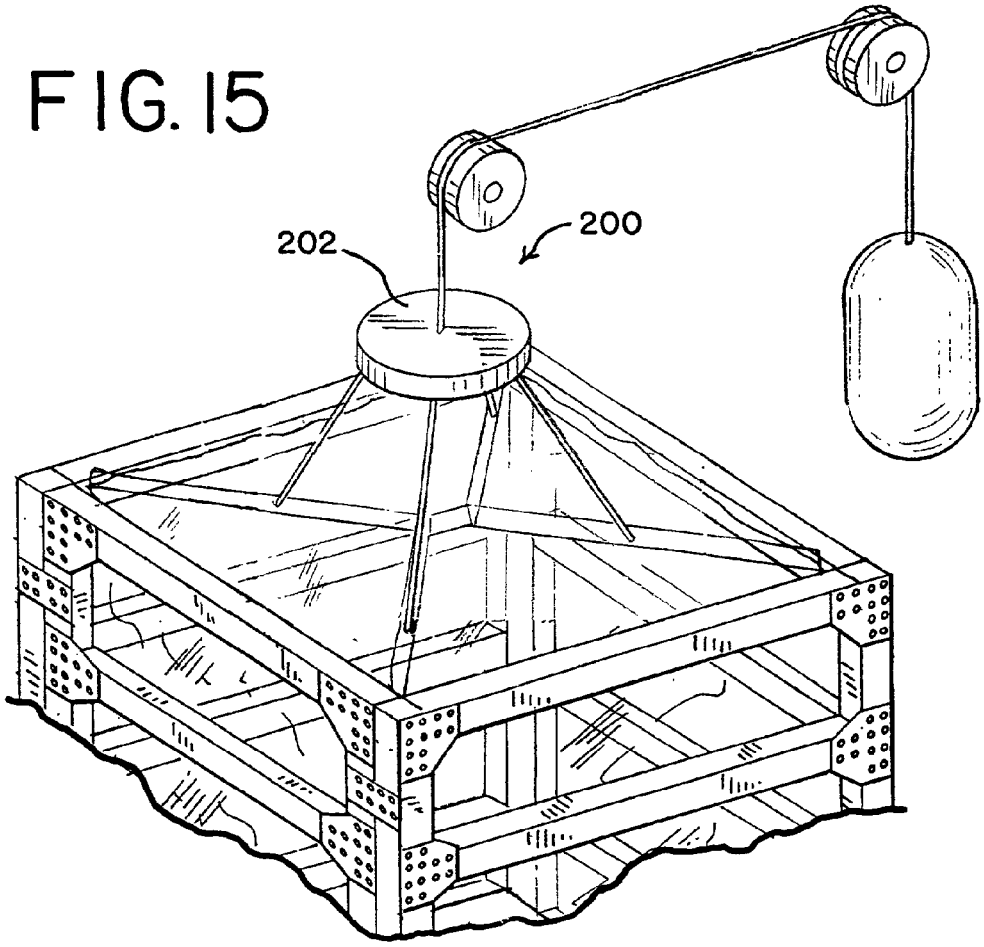
FIG. 15 is a schematic perspective view of an alternative embodiment of the container hanger system of the present invention.
Figure 16:
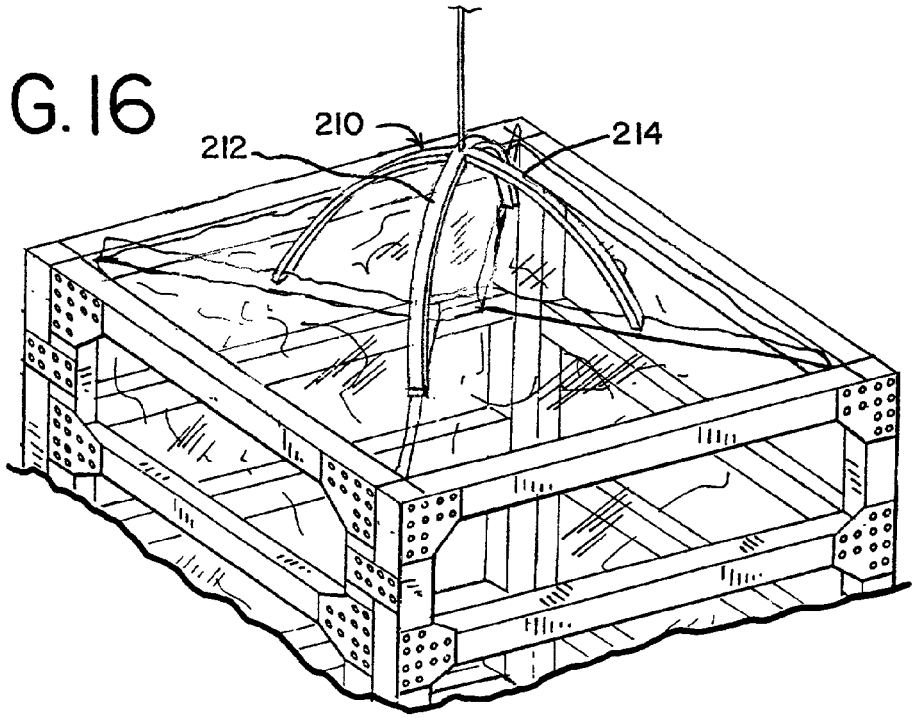
FIG. 16 is a schematic perspective view of another alternative embodiment of the container system of the present invention.

FIGS. 10–17 disclose a hanger system 150 used in accordance with the present invention. The hanger system 150 is utilized to support the empty upper portion of the container 10 to optimize filling and draining of the container 10. For clarity, only a portion of the box 100 is shown in FIGS. 13, 15 and 16. The hanger system 150 generally includes a hanger 152, a support member 154, a cable 156 and a counterweight system 158.

Figure 7:
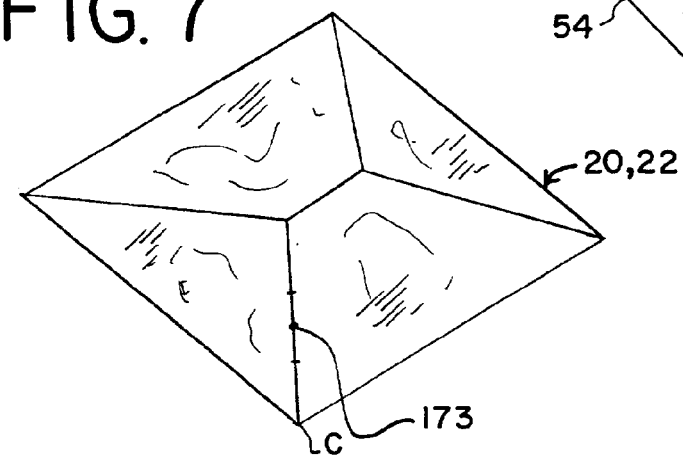
FIG. 7 is a perspective view of an end panel of the container.

As shown in FIG. 13, the hanger 150 has a first member 160 and a second member 162 connected together substantially at their respective midportions to form an x-shaped member. The angles between the members 160,162 could vary as desired. In one preferred embodiment, an angle A is approximately 70° and an angle B is approximately 110°. The first member 160 has a first end 164 and a second end 166. The second member 162 has a first end 168 and a second end 170. The hanger 150 serves as a spreader member wherein the ends of the members 160,162 spread out over the end panel or top panel 22 of the flexible container 10. Each end 164–170 has a depending member 172 extending downwardly therefrom. In a preferred embodiment, the depending members 172 are pivotally connected to the first member 160 and second member 162. The pivotal connection provides benefits in the draining process and the filling process as will be described below. The depending members 172 each have a protrusion that is received in an eyelet 173 connected to the container 10 to hang the container 10 from the hanger 152. In a preferred embodiment, and as shown in FIG. 7, the eyelets 173 are located along a diagonal seam between 35% and 65% of the length of the seam as measured from an outer corner C of the filled container 10. It is understood that the hanger members 160,162 can have different lengths to accommodate containers 10 of different sizes. The hanger 152 provides a spider-shaped support configuration that spreads out the container 10 so that the container 10 fills up with fluid with a minimum amount of pleating against the Lexan™ panels 113 of the side panels of the box 100. It is further understood that the number of members and depending members of the hanger 152 could vary depending on the size of the container 10 and the desired hanging configuration.

As shown in FIGS. 11 and 12, the support member 154 is generally an overhead support bracket 154. The support bracket 154 has a first post 174 and a second post 176 connected by a cross rail 178. The first post 174 is connected to one side of the top portion of the box 100 and the second post 176 is connected to an opposite side of the top portion of the box 100. Thus, the cross-rail 178 spans over the open top portion of the box 100. In its simplest form, the container 10 is adapted to be hung from the hanger 152 by the cable 156 that is connected between the hanger 152 and the support member 154.

Figure 13A:
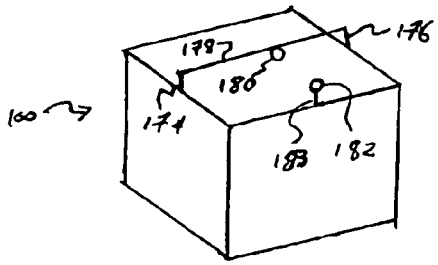
FIG. 13*a* is a schematic representation of the container hanger system of the present invention.

The counterweight system 158 generally includes a first pulley 180, a second pulley 182, and a counterweight 184. The counterweight system 158 allows tension adjustment to the upper portion of the container 10. The first pulley 180 is connected to the cross rail 178 and the second pulley 182 is connected to a side of the box 100 by a suitable support 183 for pulley 182 as schematically shown in FIG. 13*a*. The hanger system 150 is connected such that a first end 186 of the cable 156 is connected to the hanger 152 and a second end 188 of the cable 156 is connected to the counterweight 184. The counterweight 184 is suspended outside and adjacent to the box 100. The cable 156 passes over the first pulley 180 and the second pulley 182. The hanger system 150 provides an upward biasing force to the top portion of the flexible container 10. By changing the weight of the counterweight 184, tension on the container 10 can be adjusted, in keeping with the volume of the container 10.

FIGS. 15 and 16 disclose alternative embodiments of hanger systems for the container 10. FIG. 15 discloses a hanger system 200 having a hanger 202. The hanger 202 has a plurality of cables 204 that depend from the hanger 202 and are connected to the container 10. The hanger 202 acts to spread the cables 204 to prevent tangling. The hanger system 200 is hung from the support member 154 and has a counterweight system 158. FIG. 16 discloses another hanger system 210. The hanger system 210 has a first flexible member 212 and a second flexible member 214 connected together substantially at their respective midportions. The ends of the flexible members 212,214 are adapted to be connected to the container 10. The flexible members 212, 214 have a curved configuration. The hanger system 210 would be hung from the support member 154 and would also utilize the counterweight system 158. When the container 10 is initially hung, the members 212,214 bend towards a downward U-shape. During the filling of the container 10, the members 212,214 would straighten as the top panel of the container transitioned from a vertical configuration to a horizontal configuration. It is understood that the hangers of the hanger system of the present invention could be modified to include a additional members such as to be employed with any N-sided polygon foot print with at least one connection per corner.

Figure 27:
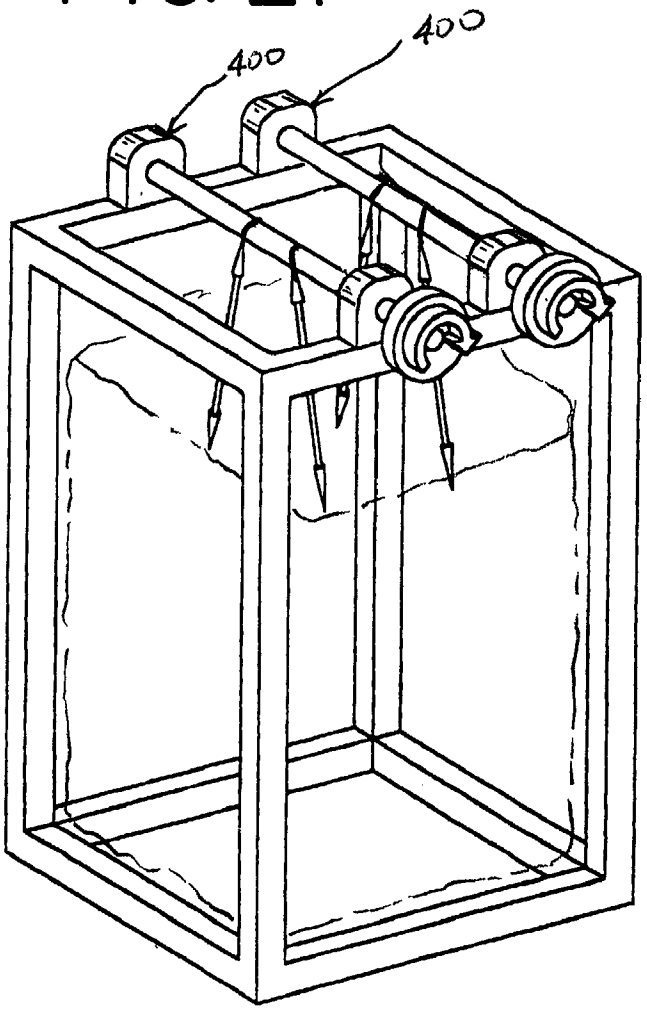
FIG. 27 is a schematic perspective view of an alternative embodiment of the container hanger system of the present invention.
Figure 26:
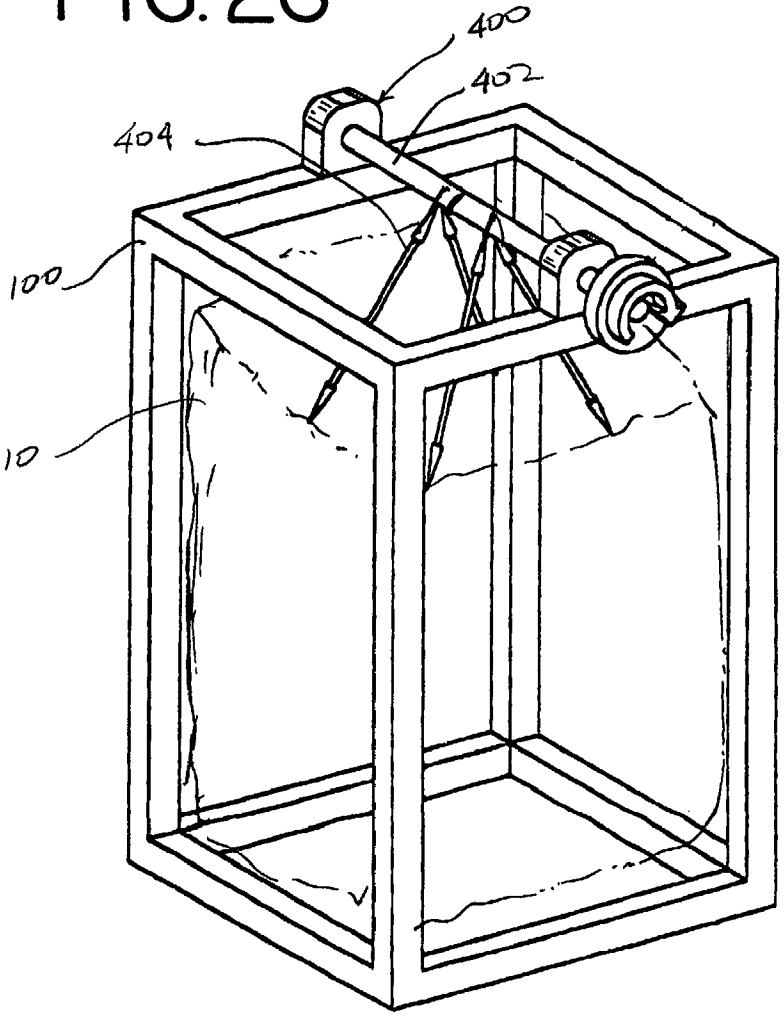
FIG. 26 is schematic perspective view of an alternative embodiment of the container hanger system of the present invention.

FIGS. 26 and 27 disclose additional alternative embodiments of hanger systems for the container 10. FIG. 26 discloses a spring assembly 400 that is mounted to a top portion of the supporting box 100, shown schematically. The spring assembly 400 has a rod 402 having cords 404 extending from and connected to the rod 402. The rod 402 is rotatably biased to wind the cords on the rod 402. This provides an upward biasing force on the container 10. As shown in FIG. 27, two spring assemblies 400 can also be provided. It is further understood that additional spring assemblies 400 could be employed as desired.

It is further understood that hanger systems having different configurations to provide an upward biasing force on the container 10 are possible. For example, springs could be employed between the box 100 and container 10. Other elastic members could be configured to apply an upward force on the container. Another box could be utilized and connected to the box 100 in a coaxial fashion. A cylinder assembly could be connected between the two coaxial boxes to provide an upward biasing force or tension on an upper portion of the container 10.

Once the container 10 is placed in the box 100 and hung using the hanger system 150, the container 10 can be filled. Fluid is pumped using, for example a peristaltic pump (not shown) that can be attached to a side portion of the box 100. The pump will pump fluid through the port hose attached to the port 40 on the bottom panel 20 of the container 10 (FIG. 3). The hanging system 150 helps to suspend the container 10 uniformly within the box 100 such that there is a minimum amount of pleating of the container 10 against the side panels of the box 100. Also, the hanger system 150 permits full deployment of the bottom panel 20 of the container 10 along the contours of the bottom floor 116 of the box 100. As the container 10 continues to be filled, the sidewalls of the container 10 deploy substantially uniformly against the side panels of the box 100. As the container 10 nears its full volume, the pivoting depending members 172 pivot as the top panel 22 of the container 10 transitions from a generally vertical configuration to a substantially horizontal configuration.

Once filled, the container 10 is ready to be attached, for example, as part of a subsequent process. Such process may require the container 10 to be drained to deliver the fluid to another location for further processing. In this situation, the pump will pump fluid from the container 10. As fluid is pumped from the container 10, the counterweight 184 maintains an upwardly biasing force on the container 10 to assist in the draining process. FIGS. 17*a*–17*e* schematically disclose a draining process of a flexible container 10 in the vertical configuration being vertically supported by the hanger system 150. As shown in FIGS. 17*a*–17*c*, the flexible container 10 pulls away from the box 100 as the container 10 is drained. The container 10 begins collapsing at the outermost corners of the container 10 because of the location of the connecting points with the depending members 172. The resulting shape is peaked with the volume reduction of the emptying container 10 defined by inward peaked folding pleats. As shown in FIGS. 17*d* and 17*e*, the defining shape is tent-like with the formation of vertical wrinkles 185. The vertical wrinkles 185 are defined between the hanger connection points and the draining level of the fluid within the container 10. Vertical wrinkles are more desirable than horizontal pleats as vertical wrinkles will allow greater deployment of the container 10 within the box 100 during a refilling process. As shown in FIG. 17*e*, as the fluid is pumped out, and with the corners of the bottom panel of the container 10 placed appropriately at the corners of the box 100, the bottom panel of the container 10 is sucked convex upward away from the intermediate floor of the box 100 by the evacuating action of the draining pump. This defines drainage points on the container 10 allowing fluid to run downwardly on this surface to the port 40. As shown in FIG. 14, the depending members 172 pivot inwardly as the top panel shifts from a substantially horizontal configuration to a more vertical configuration.

During a refilling process, the pump pumps fluid back into the container through the same port 40 at the bottom panel 20 of the container 10. The convex upward configuration of the bottom panel 20 is re-contoured to the bottom floor 116 of the box 100 by the weight of the fluid. The fluid also then refills the lower corners of the bottom panel 20 at the junction of the vertical wrinkles 185 on the side panels of the container 10. During the refilling of the container 10, the vertical wrinkles 185 are once again defined by the level of the fluid pushing the material towards the corners of the box 100 and by the upward connection of the hanger 152. Because of the configuration of the hanger 152 and its connection to the top panel of the container 10, the corners of the container 10, as the container 10 is filled, tend to assist one another in positioned themselves at the corners of the box 100. Because the wrinkles 185 are in a vertical configuration, the wrinkles 185 do not get trapped against the side panels of the box 100 as a horizontal fold would get trapped. The vertical wrinkles 185 rather open and deploy against the side panels of the box 100.

The hanger system 150 provides several advantages. The hanger system 150 permits the use of large volume flexible containers having a single port for use in applications that require filling, draining and then refilling without the additional expense and hazards that may be associated with flexible containers containing dip tube or vent design features. The hanger system 150 also permits complete collapse of the filled container 10 during the draining process without having to admit air into the container 10, thereby maintaining a closed system. The system 150 further provides support for refill deployment of the container 10 which minimizes undesirable pleating of the container 10. The system 150 forces the collapse of the container during draining to occur with predominately vertical wrinkles as opposed to horizontal creases that can prevent redeployment of the container 10 during refilling. This vertical collapsing configuration greatly improves the drainage performance of the container as the bottom panel of the container 10 is sucked convex upward defining lower drainage points on the container 10.

Figure 22:
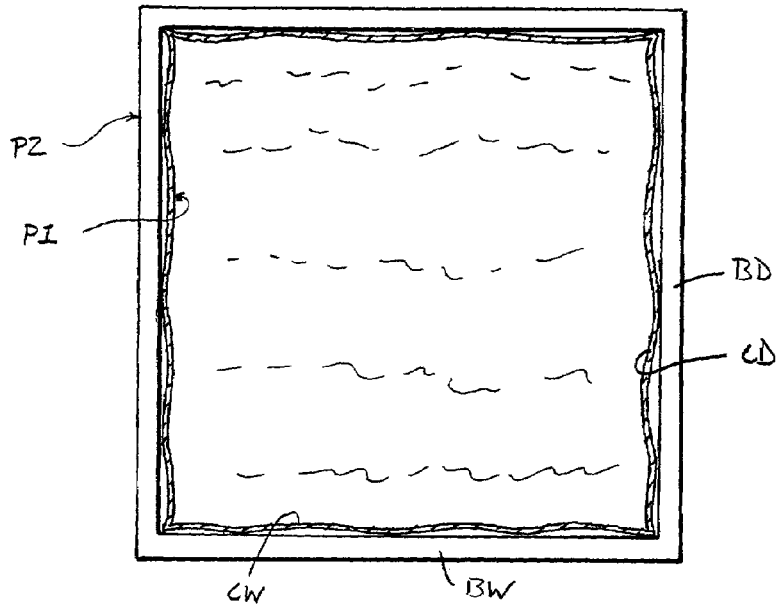
FIG. 22 is a plan view of the container positioned in the box, the container being partially filled.
Figure 23:
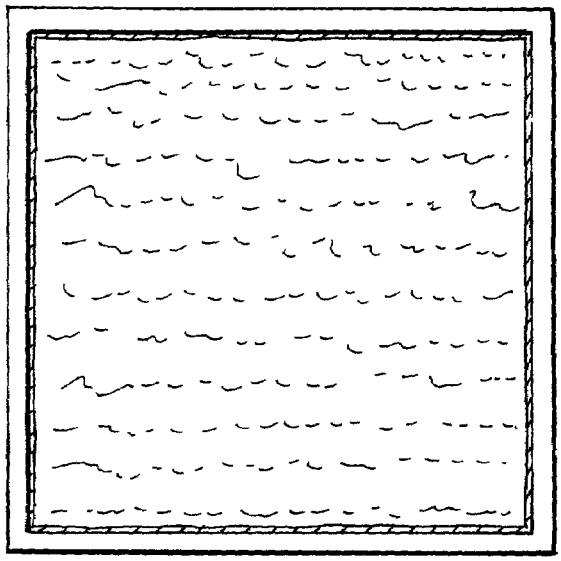
FIG. 23 is a plan view of the container positioned in the box, the container being substantially filled.
Figure 24:
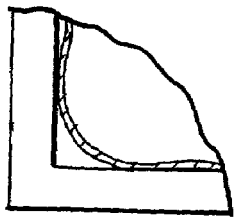
FIG. 24 is a partial enlarged view of a corner portion of a container positioned in a box.
Figure 25:
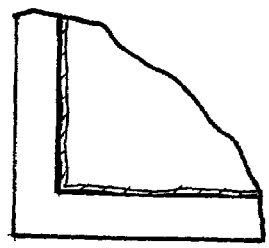
FIG. 25 is a partial enlarged view of the container of the present invention in the box.

FIGS. 22 and 23 disclose a further aspect of the invention. The flexible container 10 is sized to be larger than the box 100. In this configuration, the amount of stress on the container seams is minimized if the container 10, for example, does not become optimally aligned within the box wherein the four corners of the container are substantially adjacent the four corners of the box. FIG. 22 discloses a schematic plan view of the container 10 within the box 100. The container 10 is only partially filled with fluid. The panels of the container are defined by a container width CW and a container depth CD. The panels of the container 10 cooperate to define a first perimeter P1, i.e. P1=2*(CW+CD). The side panels of the box are defined by a box width BW and a box depth BD. The panels of the box cooperate to define a second perimeter P2, i.e. P2=2*(BW+BD). The panels of the container 10 are sized such that the first perimeter P1 is larger than the second perimeter P2. This allows for some "play" with respect to the container 10 within the box 100 and will provide a certain amount of wrinkles in the container 10 preferably at the corners of the container 10 and box 100. In a preferred embodiment, the container 10 is sized with respect to the box 100 so that the first perimeter P1 is about 2% to about 10% larger than the second perimeter P2 of the box 100. As shown in FIG. 23, when the container 10 is substantially filled with fluid within the box 100, wrinkles are formed in the container 10 at or near the corners. If the container 10 was sized substantially identically to the box 100, corners of the container 10 could pull away from the corners as shown in FIG. 24 thus putting more stress on the container 10. As shown in FIG. 25, a larger sized container 10 alleviates these potential problems wherein corners of the container 10 are optimally supported at corners of the box 100.

FIGS. 18–21 disclose a port closure 300 according to the present invention designed to provide a unique closure for the port 40 of the container 10. The port closure 300 provides both a sterile and gas permeable barrier. The port closure 300 generally includes a communication member 302, a stop member 304, a cover member 306 and a band 308. The communication member 302 is typically in the form of a tube. The tube 302 is typically made from an elastomeric material such as silicone. The size of the tube can vary depending on the particular application. In one preferred embodiment, a ¾ in. tube is used. The tube 302 has a first end and a second end, and the length of the tube is determined by the desired application. The stop member is typically in the form of a plug 304. The plug 304 is typically cylindrical and selected from material that is porous but has hydrophobic properties such that it allows gases such as air to pass through the plug 304 but prevents fluid from passing through the plug 304. In one preferred embodiment, the plug 304 is made from a porous plastic material such as polyethylene. Polytetrafluouroethylene material could also be used. Other materials are also possible and materials can be used after being treated to possess hydrophobic properties. The pore size of the material is sized so that it is capable of providing a gas permeable, sterile barrier. In a most preferred embodiment, the plug is a commercially-available Porex® hydrophobic material. The plug 304 is generally about 1 inch in length and has a diameter sized such that it will form an interference fit when inserted into an end of the tube 302. As further shown in FIGS. 18–20, the cover member 306 has a first member 310 and a second member 312. The members 310,312 can be made from cellophane or paper. In addition, one member can be paper and one member can be cellophane. As explained in greater detail below, the members 310,312 are sealed to one another to form a two-ply, peelable pouch having an opening to receive the second end of the tube 302. The band 308 is typically also made from elastic material such as silicone and can be cut from tube stock identical to the tube used in the port closure 300.

Figure 20:
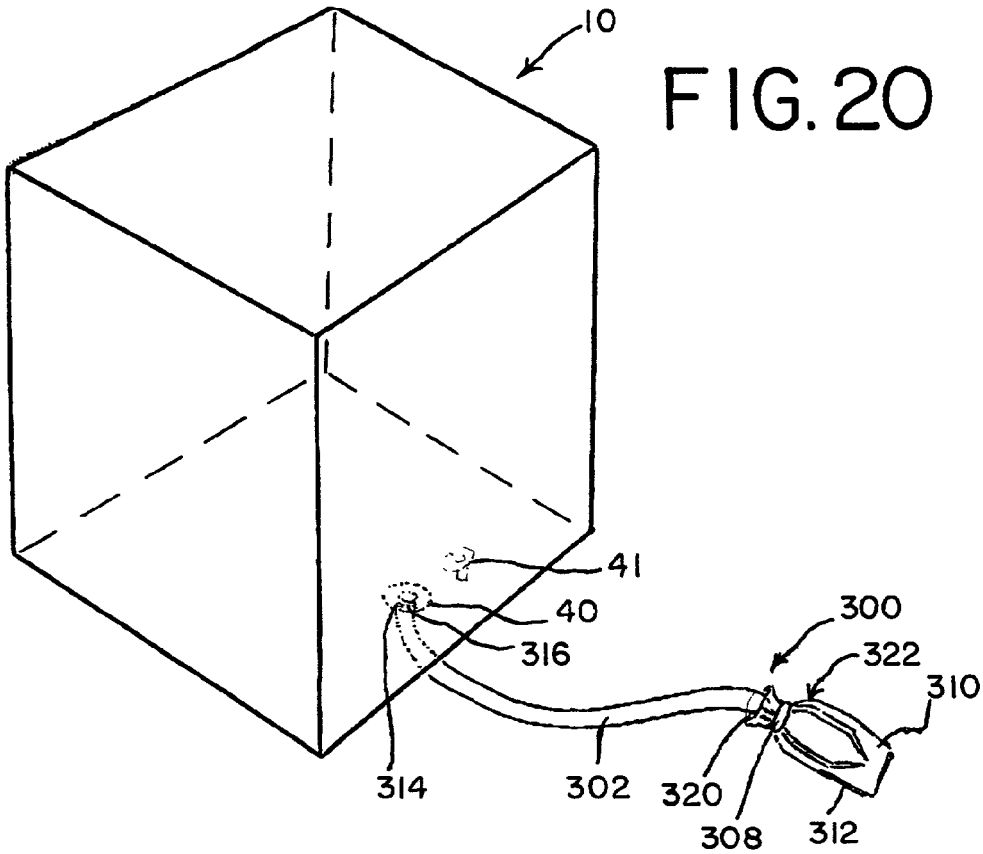
FIG. 20 is a perspective view of a port closure connected to a container.

As further shown in FIG. 20, in constructing and connecting the port closure 300 to the container 10, the tube 302 is first cut to the desired length, e.g. 6–30 feet of tubing. A first end 314 of the tube 302 is inserted over the port 40 on the container 10 to form an interference fit. A cable tie 316 can be placed around the first end 314 of the tube 302 when installed on the port 40 to more securely connect the tube 302 over the port 40. After tightening, the cable tie 316 is trimmed accordingly. The plug 304 is cut into a one inch length from the desired plug stock. As shown in FIGS. 18 and 19, the plug 304 is then inserted into a second end 318 of the tube 302. A portion of the plug 304 extends from the second end of the tube 302 to allow the operator to grasp the plug 304 on removal from the tube 302. The first and second members 310,312 of the cover 306 are sealed to one another but leaving one open end 320 (FIG. 20) to form a pouch 322. The cover 306 is then placed over the second end 318 of the tube 302 and plug 304. The band 308 is then placed around the cover 306 and the tube 302 to secure the cover 306 to the tube 302. Because the elastic band 308 is cut from tube stock identical to the tube 302, when the band 308 is placed around the tube 302, it provides a radially compressive force on the cover 306 against the tube 302. The cover 306 provides a dustcover so that if the second end 318 of the tube 302 is inadvertently dropped on the floor or otherwise touch contaminated, the porous plug 304 and tube end 318 remains clean and sterile. If a tamper evident feature is desired, the cover member 306 may be permanently affixed to the second end 318 of the tube 302 with a non-removable accessory such as a shrink band 309 (FIG. 19). In addition, as shown in FIG. 18, the cover 306 could be directly heat sealed to the tube 302 thus providing a tamper evident feature.

There are two general methods to access the plug 304 at the second end 318 of the tube 302. As shown in FIG. 18, top edges 324 of the first and second members 310,312 can be peeled apart to open the cover 306. Alternatively as shown in FIG. 19, the band 308 can be rolled down the tube 302 and the cover 306 pulled away from the second end 318 of the tube 302. In either case, once the cover 306 is removed, the plug 304 can also be removed wherein the fluid can either be drained or pumped from the container 10.

Figure 21:
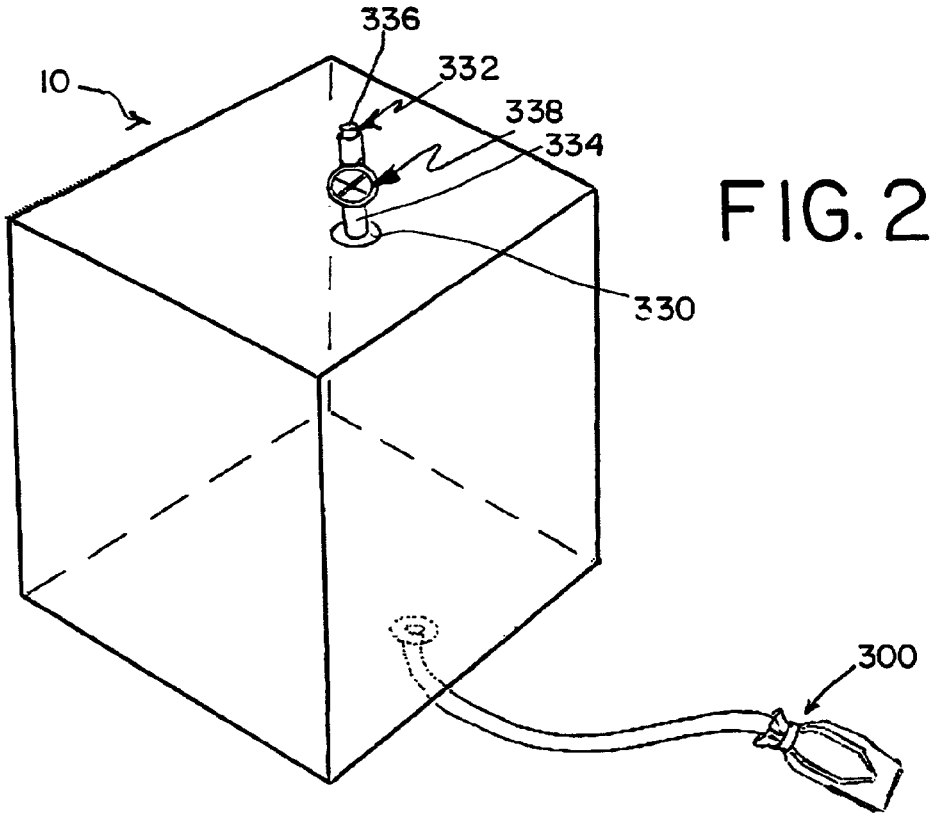
FIG. 21 is a perspective view of a container having multiple ports with a port closure connected at one port and an alternative port closure connected at the other port.

In certain instances, a container may have a plurality of ports, e.g. a fill port, a drain port and a vent port. FIG. 21 discloses a container 10 having an additional port 330 closed by a vent closure 332. The vent closure 332 is similar to the port closure 300 described above. The vent closure 332 has a short silicon tube 334 having one end connected to the additional port 330. A vent plug 336 made from the same material as the port closure plug 304 is inserted into the free end of the tube 334. The vent plug 336 allows gases to pass therethrough to equalize pressure inside the container 10 to the pressure outside the container 10. The vent plug 336 enables complete filling of the container 10 and attendant reduction of headspace (i.e., the space of the fluid level and the top of the container). This is an advantage in a stationary container application because uncontrolled headspace can cause an alteration in the gas concentrations in the fluid, thus permitting a shift in the pH of the fluid. In a container 10 that is to be transported, headspace is a particularly critical issue, because headspace will allow sloshing of the fluid during shipping. Such fluid movement can cause degradation of proteins in the fluid due to denaturation (foaming), as well as compromising the container itself due to repeated mechanical stresses (flex cracking).

As further shown in FIG. 21, if desired, a valve 338 can be positioned within the tube 334, or communication member, in between the first end and the second end. The valve 338, such as a stopcock valve or other suitable valve, can be open or closed to allow or prevent venting of the container 10 as desired. For example, the valve 338 can be opened to vent the container 10 during the later stages of filling. Conversely, the valve 338 can be closed such as during shipping and draining.

The port closure 300 of the present invention provides numerous advantages, namely providing a sterile closure but still having gas-permeable properties. The sterile barrier prevents contamination. The permeable property of the closure 300 equalizes the internal pressure within the tube 302, and therefore the container 10 that is in communication with the tube 302, and the external pressure around the container 10. Pressure equalization allows sterile air to enter the container 10, which facilitates manipulation of the container 10 during handling and installation. For example, pressure equalization allows the large, flexible, collapsible container 10 to be easily manipulated while empty, without the risk of introducing non-sterile air into the container 10. It is essential to have air in the container 10 during handling and installation, because the air acts as a lubricant allowing the container panels to move independently. However, having air in the container 10 during sterilization and shipping contributes to container bulk. Container bulk is undesirable and attempted to be minimized to the greatest extent possible. Thus, it is desirable to be able to ship the container 10 filled with fluid but with as little air as possible, and then to allow air to enter the container 10 without breaching sterility. The sterile, gas permeable port closure provides these advantages. If the second end 318 of the tube 302 is accidently dropped or introduced to contaminants, the cover member 306 maintains the second end 318 of the tube 302 and plug 304 sterile. In addition, the port closure 300 does not require injected molded ports or stainless steel couplings, thus providing cost savings. Furthermore, by using an interference fit between the tube 302 and plug 304, no solvents are needed to connect the plug 304 to the tube 302, therefore reducing the amount of leachables into the container 10.

It is understood that, given the above description of the embodiments of the invention, various modifications may be made by one skilled in the art. Such modifications are intended to be encompassed by the claims below.

What is claimed is:

1. A support system comprising:

a closed flexible container within a rigid box, the flexible container defining a sterile barrier to an interior having a volume of at least about 200 liters, the flexible container having a first perimeter defined by a substantially horizontal cross-sectional plane and the box having a second perimeter defined by the substantially horizontal cross-sectional plane when the flexible container is positioned within the box, the first perimeter being greater than the second perimeter; and a container hanger connected to the rigid box and to a portion of the top side of the flexible container and applying an upward force to the flexible container.

2. The support system of claim 1 wherein the container has a top side having a top outer perimeter edge and sidewalls in supportive contact with sidewalls of the rigid box; and the container hanger is spaced inward from the top outer perimeter edge.

3. The hanger system of claim 2, wherein the portion of the top side of the flexible container further comprises a plurality of connection locations connected to the container hanger.

4. The hanger system of claim 2, wherein the top side of the flexible container has a diagonal seam, and the container hanger is connected to the flexible container along the diagonal seam between about 35% and about 65% of a length of the seam measured from an outer corner of the flexible container.

5. The hanger system of claim 2, wherein the container hanger further comprises a counterweight connected to the portion of the top side of the flexible container.

6. The hanger system of claim 2, wherein the container hanger further comprises an elastic member assembly connected to the portion of the top side of the flexible container.

7. The hanger system of claim 2, wherein the container hanger applies a variable upward force to the top portion of the flexible container.

8. The hanger system of claim 2, wherein the container hanger comprises a connection member connected to the portion of the top side of the flexible container, and the connection member being vertically movable during filling and emptying of the flexible container.

9. The system of claim 1 wherein the first perimeter is within a range of about 2% to about 10% larger than the second perimeter.

10. The system of claim 1, wherein the first and second perimeters have one of a generally square or rectangular shape.

11. The system of claim 1, wherein the first perimeter is greater than the second perimeter along substantially all of a vertical height of the flexible container and the box.

12. The system of claim 11, wherein the first perimeter is within a range of about 2% to about 10% larger than the second perimeter.

13. The system of claim 1, wherein a corner of the flexible container is supported by a corner of the box when the flexible container contains fluid.

14. The system of claim 1, wherein the flexible container has an internal volume greater than an internal volume of the box when the container is positioned outside of the box.

15. A hanger system comprising:

a closed large volume flexible medical container having a volume greater than 200 liters in a rigid box, and means for upwardly biasing a top portion of the flexible container, the means for upwardly biasing being connected to the rigid box and the top portion of the flexible container wherein the top portion of the flexible container has a diagonal seam, and the means for upwardly biasing is connected to the flexible container along the diagonal seam between about 35% and about 65% of a length of the seam measured from an outer corner of the flexible container.

16. A hanger system comprising:

a closed large volume flexible medical container having a volume greater than 200 liters and forming a sterile barrier to an interior of the container, the flexible container disposed in a rigid box, the large-volume flexible medical container having sidewalls in supportive contact with sidewalls of the rigid box; and means for upwardly biasing a top portion of the flexible container, the means for upwardly biasing being connected to the rigid box and the top portion of the flexible container wherein the means for upwardly biasing further comprises a counterweight connected to the top portion of the flexible container.

17. A large-volume flexible container support system, comprising:

a rigid box having an interior volume;

a large-volume flexible container inside of the box and having a perimeter greater than the interior perimeter of the box; and a container hanger connected to a top portion of the large-volume flexible container and biasing the top portion of the large-volume flexible container upward;

wherein the top portion of the large-volume flexible container has a diagonal seam, and the container hanger is connected to the large-volume flexible container along the diagonal seam between about 35% and about 65% of a length of the seam measured from an outer corner of the large-volume flexible container.

18. A large-volume flexible container support system, comprising:

a box having an interior volume;

a closed large-volume flexible container inside of the box, the flexible container having a first perimeter defined by a substantially horizontal cross-sectional plane and the box having a second perimeter defined by the substantially horizontal cross-sectional plane when the flexible container is positioned within the box, the first perimeter being greater than the second perimeter; and a container hanger connected to a top portion of the large-volume flexible container and biasing the top portion of the large-volume flexible container upward;

wherein the container hanger further comprises a counterweight connected to the top portion of the large-volume flexible container.

* * * * *